US011749453B2

(12) United States Patent
Hakim et al.

(10) Patent No.: US 11,749,453 B2
(45) Date of Patent: Sep. 5, 2023

(54) ASSEMBLY FOR AUTOMATIC TAP ADJUSTMENT OF A POWER TRANSFORMER USING LOAD TAP CHANGER AND A METHOD AND SUPPORT ASSEMBLY FOR MOUNTING THE SAME

(71) Applicant: WEG TRANSFORMERS USA LLC, Washington, MO (US)

(72) Inventors: Shamaun Hakim, Washington, MO (US); Jesus Antonio Herrera Juarez, Washington, MO (US); Azam Ali R. Shaikh, Washington, MO (US)

(73) Assignee: WEG TRANSFORMERS USA LLC, Washington, MO (US)

( * ) Notice: Subject to any disclaimer, the term of this patent is extended or adjusted under 35 U.S.C. 154(b) by 0 days.

(21) Appl. No.: 18/009,593

(22) PCT Filed: Apr. 4, 2022

(86) PCT No.: PCT/US2022/023306

§ 371 (c)(1),
(2) Date: Dec. 9, 2022

(87) PCT Pub. No.: WO2022/216605

PCT Pub. Date: Oct. 13, 2022

(65) Prior Publication Data

US 2023/0197335 A1 Jun. 22, 2023

Related U.S. Application Data

(60) Provisional application No. 63/171,899, filed on Apr. 7, 2021.

(51) Int. Cl.
*H01F 29/04* (2006.01)
*H01F 29/02* (2006.01)
(Continued)

(52) U.S. Cl.
CPC ..... *H01F 29/04* (2013.01); *H01F 27/04* (2013.01); *H01F 29/025* (2013.01); *H01H 9/0027* (2013.01); *H01F 27/12* (2013.01)

(58) Field of Classification Search
CPC ..... H01F 29/04; H01F 29/025; H01F 27/04; H01F 27/12; H01H 9/0027
See application file for complete search history.

(56) References Cited

U.S. PATENT DOCUMENTS 9,728,327 B2 * 8/2017 Shen ..... H01H 9/0044
2005/0099741 A1 5/2005 Stenestam et al.
(Continued)

FOREIGN PATENT DOCUMENTS

WO 2021/001333 A1 1/2021
WO WO-2021/055858 A1 3/2021

OTHER PUBLICATIONS

On-Load Tap-Changer ECOTAP VPD Operating Instructions, 6107891/02 EN, Appendix A, Maschinenfabrik Reinhausen (Oct. 2020).
(Continued)

*Primary Examiner* — Emily P Pham
(74) *Attorney, Agent, or Firm* — Sandberg Phoenix & von Gontard PC

(57) ABSTRACT

Transformer assembly has an input terminal, principal housing with main chamber for high voltage coil(s) having plurality of taps, low voltage coil(s) and retaining oil. An auxiliary housing extends outwardly from principal housing and is fluidly connected to main chamber so that auxiliary housing contains oil. A potential transformer; load tap changer having a controller, a motor and a plurality of switches; electrical wiring connected to taps, switches within auxiliary housing chamber are submerged by oil within auxiliary chamber; load tap change controller can adjust taps while the switches and electrical connections are submerged in oil of auxiliary housing chamber. The upper
(Continued)

level of oil in the main housing chamber is at a level equal to or above the switches of the load tap changer. The auxiliary housing has an access opening and cover. System apparatus with frames, having beams, lattices and cable guides for routing cables for assembly.

12 Claims, 18 Drawing Sheets

(51) Int. Cl.

| | |
|---|---|
| ***H01F 27/04*** | (2006.01) |
| ***H01H 9/00*** | (2006.01) |
| *H01F 27/12* | (2006.01) |

(56) References Cited

U.S. PATENT DOCUMENTS

| | | | | |
|---|---|---|---|---|
| 2009/0200290 | A1 | 8/2009 | Cardinal et al. | |
| 2013/0307494 | A1* | 11/2013 | Meinecke | H02J 3/1878 323/205 |
| 2016/0033980 | A1 | 2/2016 | Carlen et al. | |
| 2017/0336243 | A1 | 11/2017 | Saveliev et al. | |
| 2020/0114393 | A1 | 4/2020 | Frimpong et al. | |

OTHER PUBLICATIONS

Voltage regulator ECOTAP VPD Control Pro Operating Instructions, 5252433/08 EN, Appendix B, Maschinenfabrik Reinhausen (Oct. 2020).

Motor-Drive Unit ECOTAP VPD MD&C Operating Instructions, 6117331/02 EN, Appendix C, Maschinenfabrik Reinhausen (Nov. 2018).

International Search Report dated Jul. 28, 2022 in PCT App. No. PCT/US2022/023306.

Written Opinion dated Jul. 28, 2022 in PCT App. No. PCT/US2022/023306.

Search Report and Technical Examination Report, dated May 22, 2023 in Brazilian Patent Application No. BR112022026124-1.

* cited by examiner

ASSEMBLY FOR AUTOMATIC TAP ADJUSTMENT OF A POWER TRANSFORMER USING LOAD TAP CHANGER AND A METHOD AND SUPPORT ASSEMBLY FOR MOUNTING THE SAME

CROSS-REFERENCE TO RELATED APPLICATIONS

This application claims the benefit of U.S. Provisional Application No. 63/171,899, filed on Apr. 7, 2021, entitled ASSEMBLY FOR AUTOMATIC TAP ADJUSTMENT OF A POWER TRANSFORMER USING LOAD TAP CHANGER AND A METHOD AND SUPPORT ASSEMBLY FOR MOUNTING THE SAME.

BACKGROUND

The statements in this section merely provide background information related to the present disclosure and may not constitute prior art.

This application relates generally to the field to power distribution transformers, and more specifically, to the field of pad-mount distribution transformers that provide electrical service to residential or small commercial consumers.

In the last 100 years, having electric power has become a basic need to modern society. Providing electrical power is a lengthy and labor-intensive process that requires generating power from a fuel source and transmitting the generated power over large distances to be distributed to the end user consumers. At each step, large and expensive equipment plays a pivotal role in ensuring electric power is adequately delivered to the consumers.

Before power can be supplied to the consumers, it must first be generated by some type of generation system, usually a power plant. Most generation systems involve a turbine that must be turned continuously by a source, where it includes a shaft that acts as a rotor that interacts with a stator to generate a source of alternating-current electric power. Essentially, mechanical energy from a fuel source is converted by the motion into electrical power.

Once generated, the power must be transmitted from the generation source to the end user. This transmission process involves at least a first power transformer that steps the voltage up to higher levels for transmission over long distances with minimal losses. A typical transmission voltage level is 138 kilovolts (kV), but voltages in the range of 69-500 kV are common. Once the power is stepped up to a higher voltage level, it is transmitted over long distances to substations, prior to being stepped back down to standard distribution voltage levels. A typical distribution voltage is about 600V, though up to 12.5 kV is common.

Prior to being used by the end user of the electric power, the voltage must once again be stepped down to the appropriate levels. In the case of residential or small commercial end users, a typical voltage is approximately 120V AC in the United States.

Between the substation and the end user, there is at least one power transformer along the distribution path. Usually, having more end users on a distribution line will necessitate more power transformers to provide continuous service to the entire line.

A typical power transformer has a high-voltage side and a low-voltage side, or as is more commonly stated, a primary side and a secondary side. The transmission lines will interact with the power transformers at the substations on the primary side, while the secondary side of the power transformer receives the power and transmits it along the distribution lines at the lower voltages previously noted. Power transformers situated along the distribution lines will step down the voltage even further, for example, to the previously noted 120V AC level in the case of residential or small commercial consumers in the United States.

As more consumers are added along a distribution line, or as power demand increases along the distribution line, the voltage level of the distribution line experiences a phenomenon known as "droop". Essentially, when droop occurs, the supply voltage, for example, 12.5 kV on the primary side of the power distribution transformer, is not sufficient to provide adequate power at the required voltage level on the secondary side of the power transformer, for example, at 120 or 240 VAC. When this occurs, brownouts may occur.

A commonly used transformer is a pad-mounted or padmount transformer. These padmount transformers configured in locked steel cabinets and placed on concrete pads in a commercial or residential area. As they are typically mounted on the ground, all electrical cables in and out of these padmount transformers are underground. Since they are lockable, they can be placed in areas where no secured fencing is required. One or more padmount transformers can serve a commercial or office building or buildings, or numerous residential homes. Within the lockable steel cabinet of a padmount transformer are transformer coil pairs, a primary and secondary coil. The primary coil receives the service power from the power grid and the secondary coil that is electromagnetically coupled to the primary coil provides the output power service to electrical customers. The steel cabinets are sealed with the coil pairs within an internal cavity that is a tank which is filled with oil. The coil pairs are within the tank and within the oil during operations. Various different oils can be used within the tank and the oil level can be monitored by various known means. Additionally, the coil tanks can also have gas or a vacuum within the tanks in addition to the oil that provides a gas "cushion" above the oil. Often, a gas such as nitrogen is under positive or negative (vacuum) gauge pressure which is located in the tank above the oil or a top surface of the oil within the internal cavity. This gas can be provided to allow expansion or contraction of the volume of oil in the sealed internal cavity due to temperature changes as well as to drive out or eliminate water or moisture within the tank and to stabilize the pressure within the oil filled tank and about the coils during operation.

The wiring terminals for the service power to the primary coil and the output service power to customers distribution lines typically enter the sealed oil-filled tank through either from an adjacent cabinet or another compartment of the same cabinet that is not within the oil-filled tank. Additionally, where the primary or secondary coils are configured with more than one tap, additional wiring to the taps of the coils is within the oil-filled tank. Each coil can have in excess of 10 taps and are often up to 34 with a center tap and 17 taps on either side of the center tap. Typically each tap has a wire connected that is routed to a manual or automatic tap changer. A tap changer can be a no-load tap changer (NLTC) where the coil tap changes are made without an electrical load being present. Or in other cases it can be an on-load tap changer (OLTC) where the coil tap changes are made with active electricity. OLTC tap changers are typically designed to enable the change from one tap to an adjacent tap without interruption of the electrical power.

The padmount transformers with the coils inside and within the oil-filled tank receive and provide power through input power terminals and output power terminals, typically at the top or upper side or back of the cabinet. Typically protection relays or fuses are also provided at or near these input and output terminals also within a locked cabinet or compartment of the cabinet that contains the oil filed tank with the coils. As such, these cabinets are not only configured to have an oil holding tank for the coils, but also are watertight that keeps water out even during heavy rains and sometimes being flooded, especially if mounted below ground level. Additionally, where a gas cushion is provided, the cabinets are also air-tight to retain the gas within the cavity.

To address this issue, typical power distribution transformers have the plurality of load taps on the primary side that when connected adjust the output voltage from the primary side. This enables the transformer to increase the voltage on the primary side in order to adjust the voltage on the secondary side to within the desired range of output voltages. Often the changing of the selected tap can be time consuming and a tedious process, that often requires the power distribution transformer to be taken offline, and thus temporarily ceasing electrical power to the consumers along the distribution line. This is typical in the OLTC tap changers. Alternatively, a backup power transformer must be brought in to temporarily provide the continuous supply of electrical power.

The processes to manually adjust the voltage level can be very costly, requiring specialized personnel and resources to travel such as by driving a vehicle to the power transformer site to make the adjustments. The process may take several hours, and if not properly scheduled and planned, consumers may find themselves without electrical power.

As noted, existing systems also provide automatic means to detect droop that is occurring on the electrical distribution line, and to provide the detection of a droop condition to an automatic load tap changer controller that is configured to automatically change the load tap on a coil and thereby adjust the voltage on the primary side of the power transformer to compensate for the droop related voltage drop on the secondary side of the power transformer. By way of one example, Maschinenfabrik Reinhausen ("MR") provides an on-load tap-changer referred to as the ECOTAP® VPD® (registered trademarks of Maschinenfabrik Reinhausen) as described in "Voltage Regulator ECOTAP® VPD® CONTROL PRO Operating Instructions" Copyright © Maschinenfabrik Reinhausen GmbH, with publication number 5252433/08 EN and an apparent publication date of October 2020, as provided as Appendix A in the above referenced priority U.S. Provisional Application. As described therein, in this exemplary system, as described in Sections 5, an on-load tap-changer can be mounted on the underside of the cover of the transformer housing which is typically mounted horizontally with a sealing module or arrangement for sealing a required access hole in the transformer cover. The access hole allows the operative coupling of the externally mounted motor to the internally mounted motor driven tap changer. As noted also, these typically can only be mounted to transformers where the coil tanks are completely filled with oil. In this example, the load tap changer is mounted within the tank with a control portion extending through an access hole for controlling the load tap changer. The wiring from the transformer to the tap changer and then from the tap changer to each of the load taps is within the tank, and extends from the taps on each coil upward in the tank to the cover mounted on-load tap changer. As disclosed In Appendix A on page 32, the prior art is that the on-load tap changer is mounted on the bottom side of the top cover with the tap changer that is required to be "fully immersed in the insulating fluid.". This is problematic where there is a gas cushion within the tank, and it is cautioned in the prior art that it is only allowed if there is sufficient distance between the gas cushion and the on-load tap-changer and its connection contacts such that the tap changer remains fully immersed at all times. Appendix A also discloses that the tap changer can be mounted vertically on a side wall of the transformer with the tank, but in such installations, the tap changer must remain fully immersed and cannot come into contact with air or the gas cushion. All wiring from the coil taps to the tap changer must be soldered as seen on page 38 of Appendix A. As noted, the tap changer is mounted on the underside of the cover with the coupled externally mounted tap changer motor and connections made to the taps are performed before the tank with the coils is completely filled with oil, as well as any gas cushion that may be applicable. Section 12 of Appendix A discloses numerous engineering drawings of details as to the current recommended prior art wiring and mounting of the on-load tap changer on an oil filled padmount transformer.

Additionally as disclosed by Appendix A, these tap changers are controlled by a control system or assembly such as MR's ECOTAP® VPD® CONTROL PRO brand also sold by MR and described in "Voltage Regulator ECOTAP® VPD® CONTROL PRO Operating Instructions" Copyright © Maschinenfabrik Reinhausen GmbH, with publication number 5252433/08 EN and an apparent publication date of October 2020, which was attached to the priority U.S. Provisional Application Appendix B. In particular, Section 4.5 of Appendix B discloses a description of a design and wiring of the load tap changer controller. Section 6 thereof discloses a typical mounting of the controller for operation with a load tap changer and motor which can often utilize a mounting to bus and cap mounting rails.

As noted above a tap changer motor drive is controlled by the controller and that provides for the automated control of the load tap changer controller, such as the MR motor drive as described in "Motor-Drive Unit ECOTAP® VPD® MD&C Operating Instructions" Copyright ©MR with a publication number 6117331/02 EN and an apparent publication date of November 2018, which was attached to the priority US Provisional Application as Appendix C. The motor drive disclosed by Appendix C is an on-load tap changer is mounted on the outside of the tap changer, such as on the cover as described above.

Even with these systems such as provided by MR, there exists a need to provide an improved means to provision a pad mounted transformer with such existing automatic load tap-changers, motors and controllers that provide for ease of integration, improved more flexible and less costly assembly on the pad mounted transformers as current arrangements are complex, and costly to install and therefore implement on pad mounted transformers.

BRIEF SUMMARY

The present disclosure provide a technical solution by being able to implement an automated on-load tap changer on a transformer that is to be mounted on a pad wherein the installation of the tap changer, motor and controller provides for an efficient and cost effective assembly with improved tap lead assembly and arrangement including terminal connections, an improved tap lead mounting support assembly, and mountings of the tap changer and tap change motor.

One aspect of the disclosure is to provide an assembly to be installed on a power distribution transformer that is configured to be mounted directly on the power transformer, and to be electrically connected to the power transformer and provide the adjustments to the primary side voltage as they are needed and to accommodate sufficient oil in the transformer housing to adequately surround and protect the load tap changer. This disclosure provides for a lateral mounting of the load tap changer that allows the upper level of oil in the main housing chamber to be at a level equal to or above the switches of the load tap changer to cool and protect the switches.

Another aspect of the disclosure is to provide an assembly that detects the voltage on the secondary side, then provides feedback to a load tap changer controller on the high side that will automatically adjust the voltage without taking the distribution line out of service.

A further aspect of the disclosure is to provide a cable routing assembly for effectively managing the routing and cable management on the interior of the power transformer cabinet, such that the assembly can be easily attached to an existing power transformer cabinet with minimal interference with the traditional internal wiring.

Further aspects of the present disclosure will be in part apparent and in part pointed out below. It should be understood that various aspects of the disclosure may be implemented individually or in combination with one another. It should also be understood that the detailed description and drawings, while indicating certain exemplary embodiments, are intended for purposes of illustration only and should not be construed as limiting the scope of the disclosure.

BRIEF DESCRIPTION OF THE DRAWINGS

Corresponding reference numerals will be used throughout the several figures of the drawings.

DETAILED DESCRIPTION

The following detailed description illustrates the disclosures by way of example and not by way of limitation. This description describes several working and prophetic embodiments, adaptations, variations, alternatives including preferred embodiments. Also, it is to be understood that the phraseology and terminology used herein is for the purpose of description and should not be regarded as limiting.

Reference is made herein as to an exemplary embodiment is a prophetic embodiment using the MR products including above mentioned MR's ECOTAP VPD on-load tap changer, MR's Voltage Regulator, MR's ECOTAP VPD CONTROL PRO, and MR's ECOTAP VPD MD&C motor drive. It should be understood that this is only one prophetic embodiment, and that other embodiments including exemplary embodiments are possible and are considered within the scope of the present disclosure.

Figure 1A:
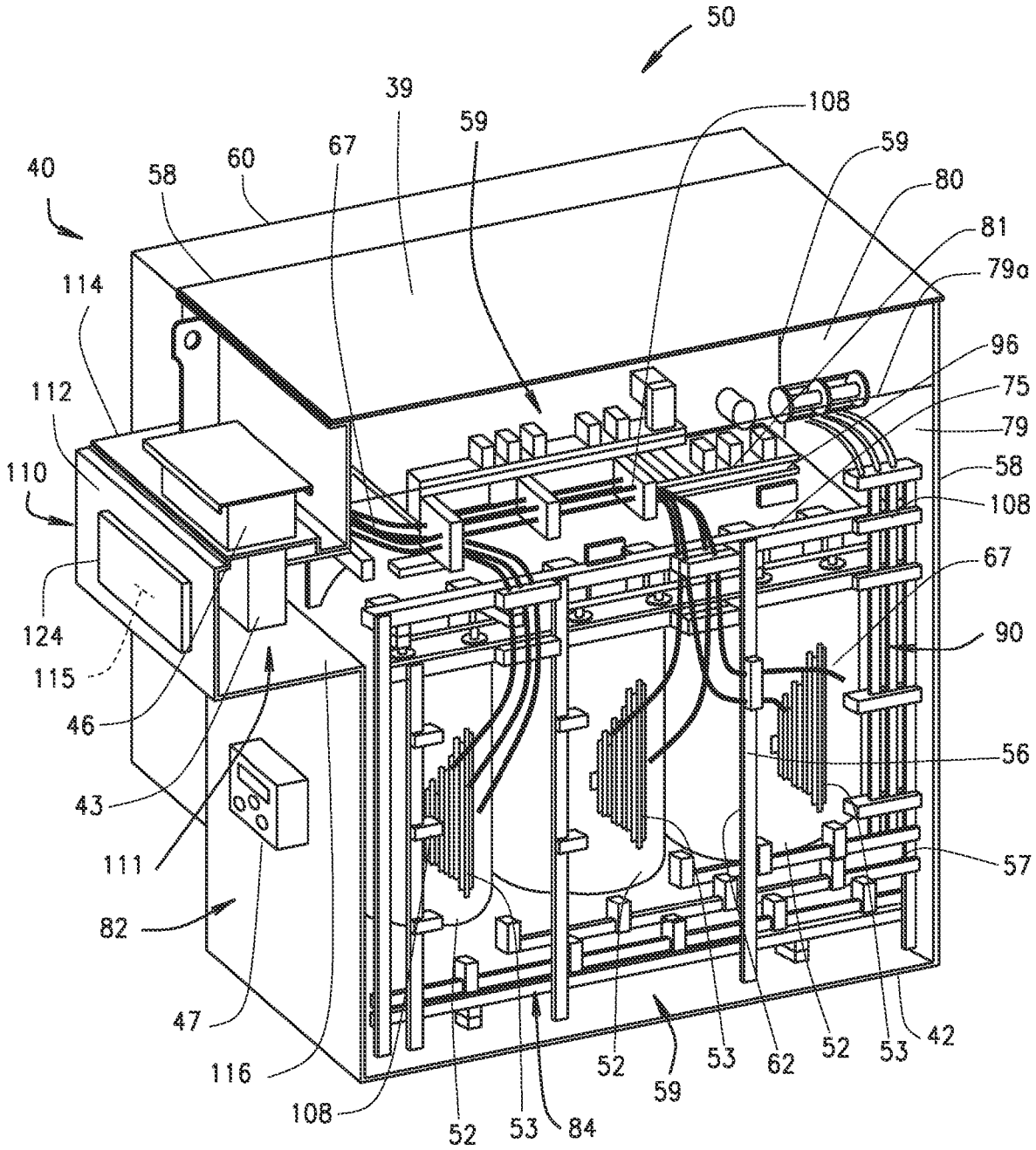
FIG. 1A shows a front isometric view of a pad mounted power transformer of an embodiment of the present disclosure with a front of a principal housing removed and a front of an auxiliary housing removed to expose a load tap changer and its switches.
Figure 1B:
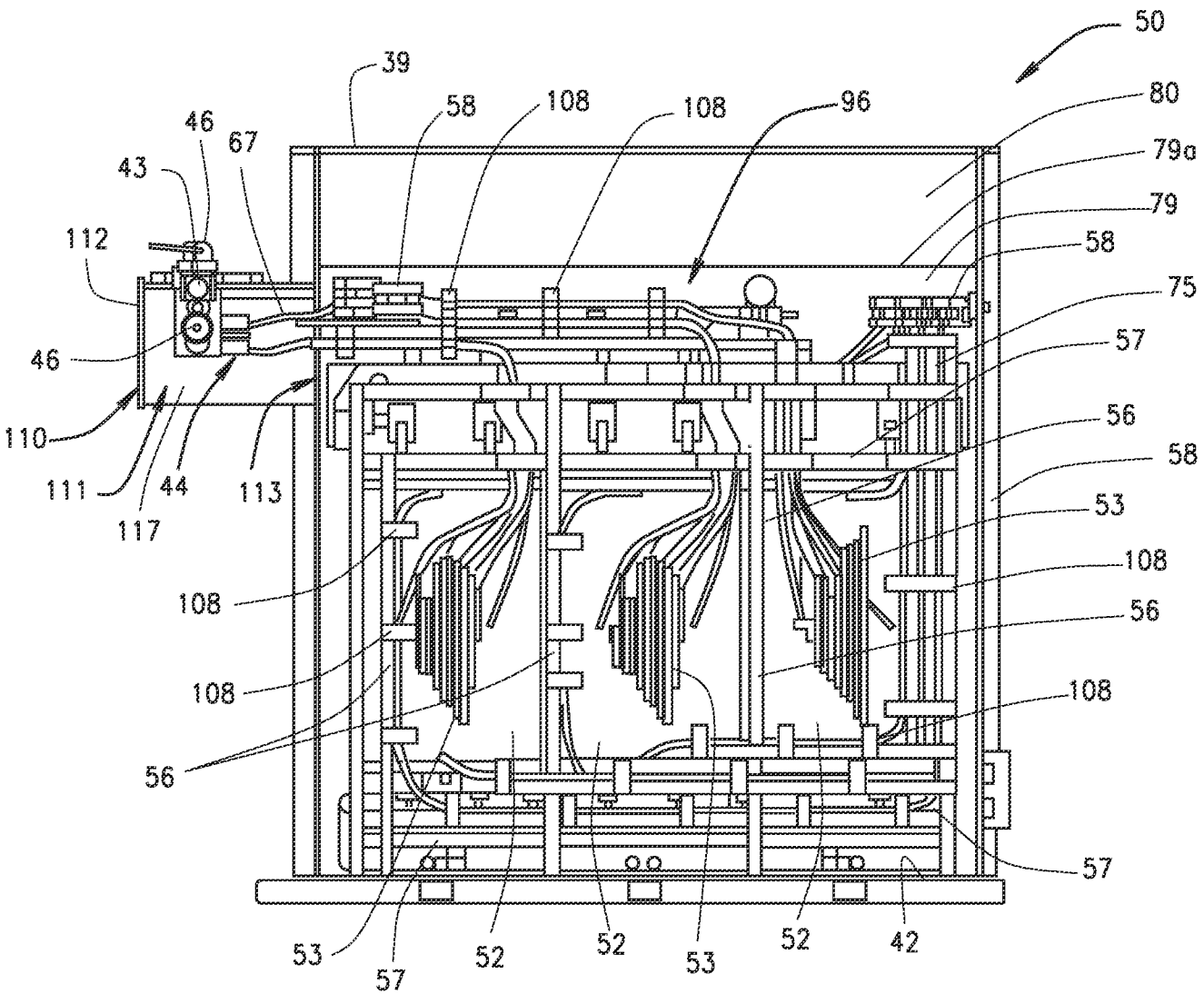
FIG. 1B shows a front view of a pad mounted power transformer of an embodiment of the present disclosure with the front of the principal housing removed and the front wall of the auxiliary housing removed to expose the load tap changer and its switches, and lead connections.
Figure 1C:
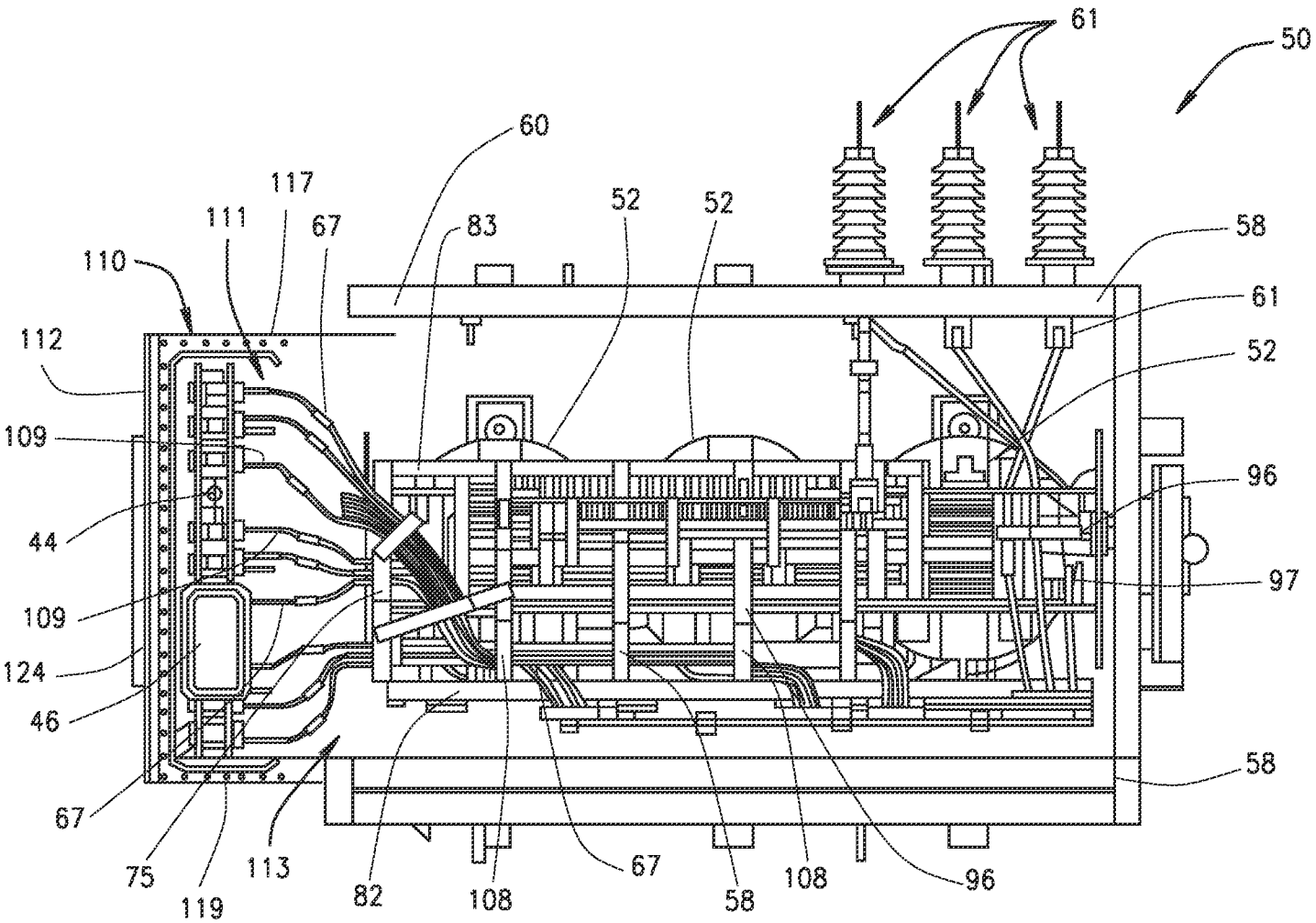
FIG. 1C shows a top and opened view of the pad mounted power transformer of an embodiment of the present disclosure according to FIG. 1B, with a top of the principal housing removed and an upper wall of the auxiliary housing removed to expose the load tap changer and lead connections.
Figure 2A:
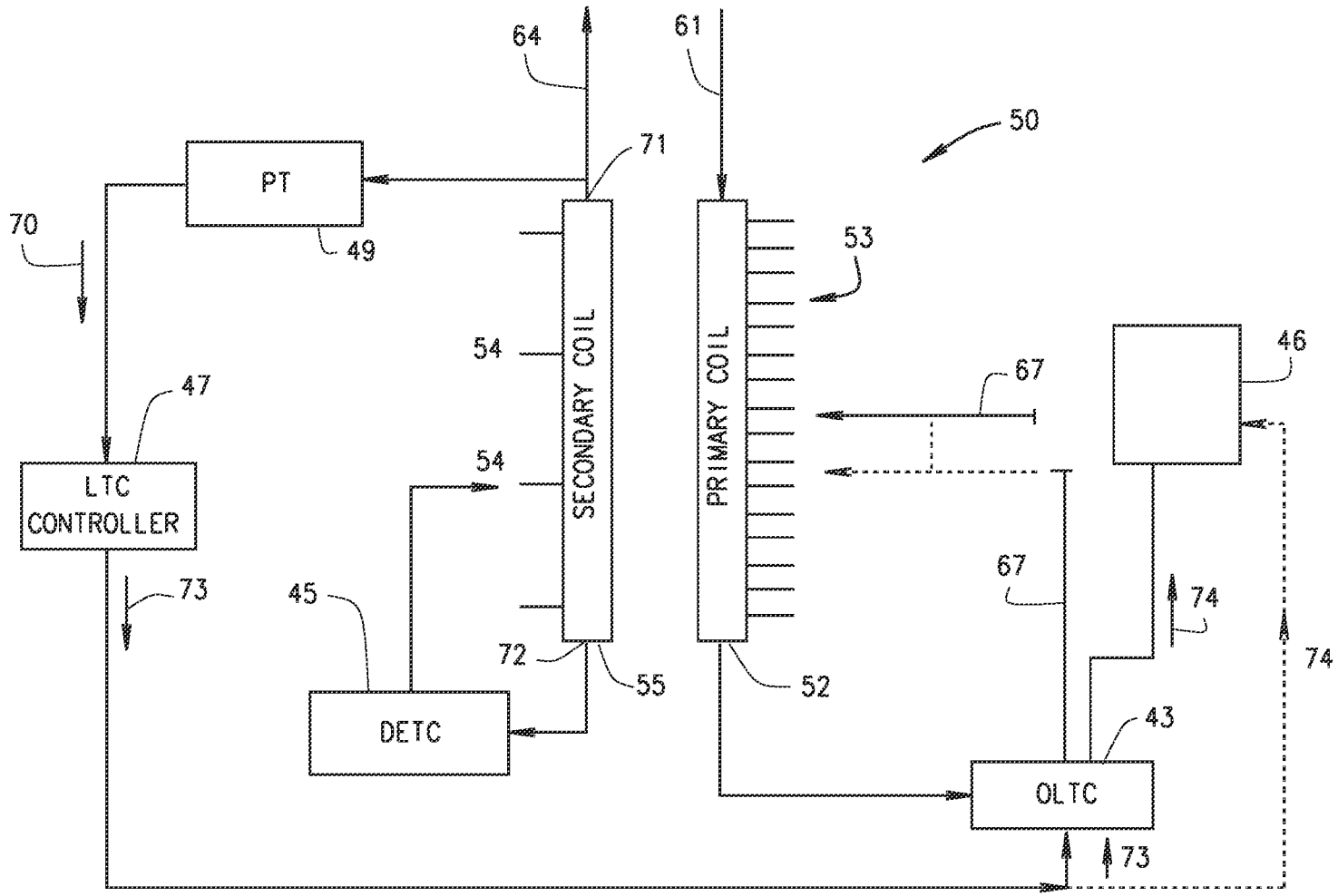
FIG. 2A is a block diagram of the functionality of the current assembly as it interacts with a functioning pad mounted power transformer, according to one exemplary embodiment.
Figure 2B:
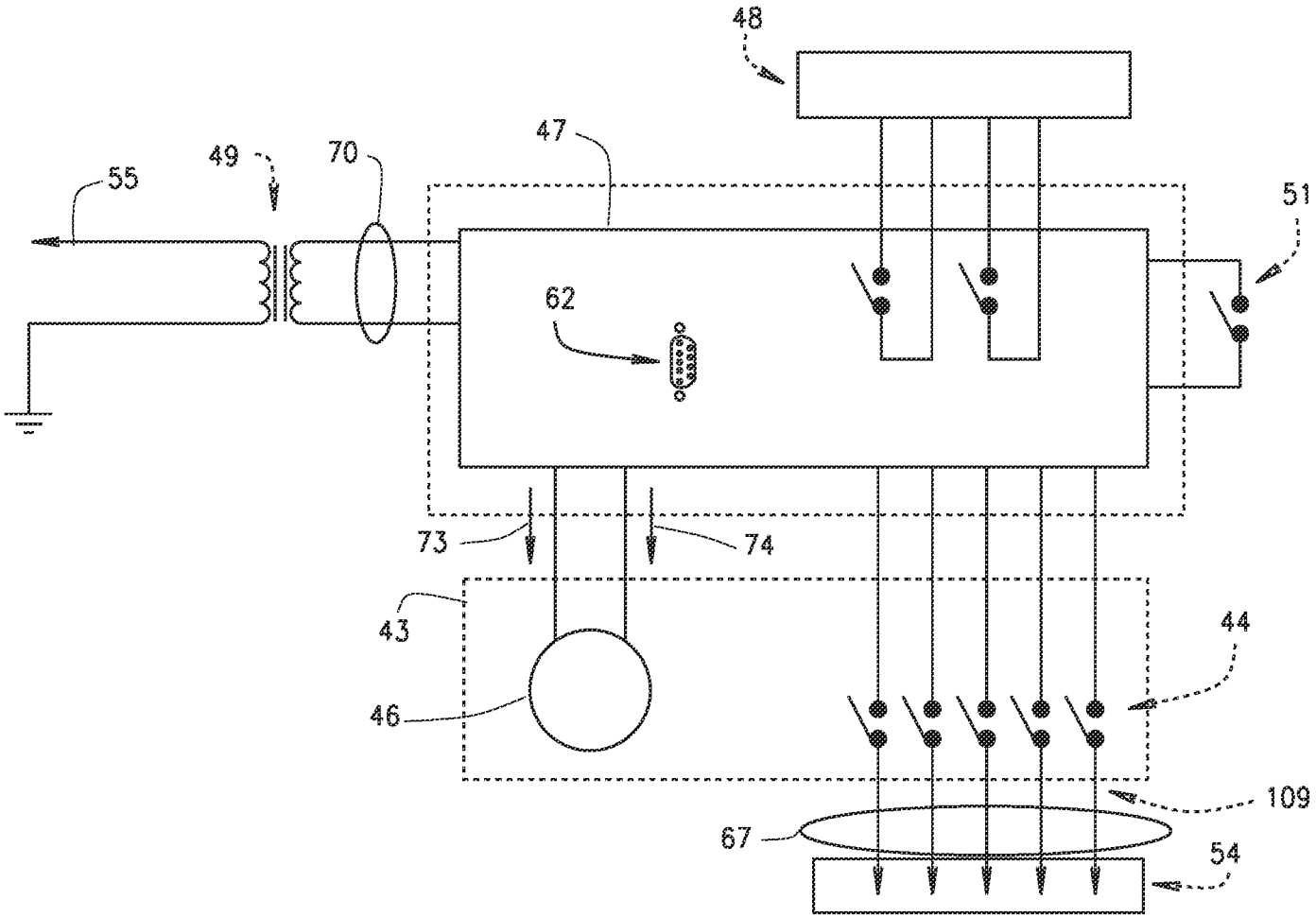
FIG. 2B is a block diagram showing wiring details of the controller with the Load Tap Changer, according to one exemplary embodiment.
Figure 3A:
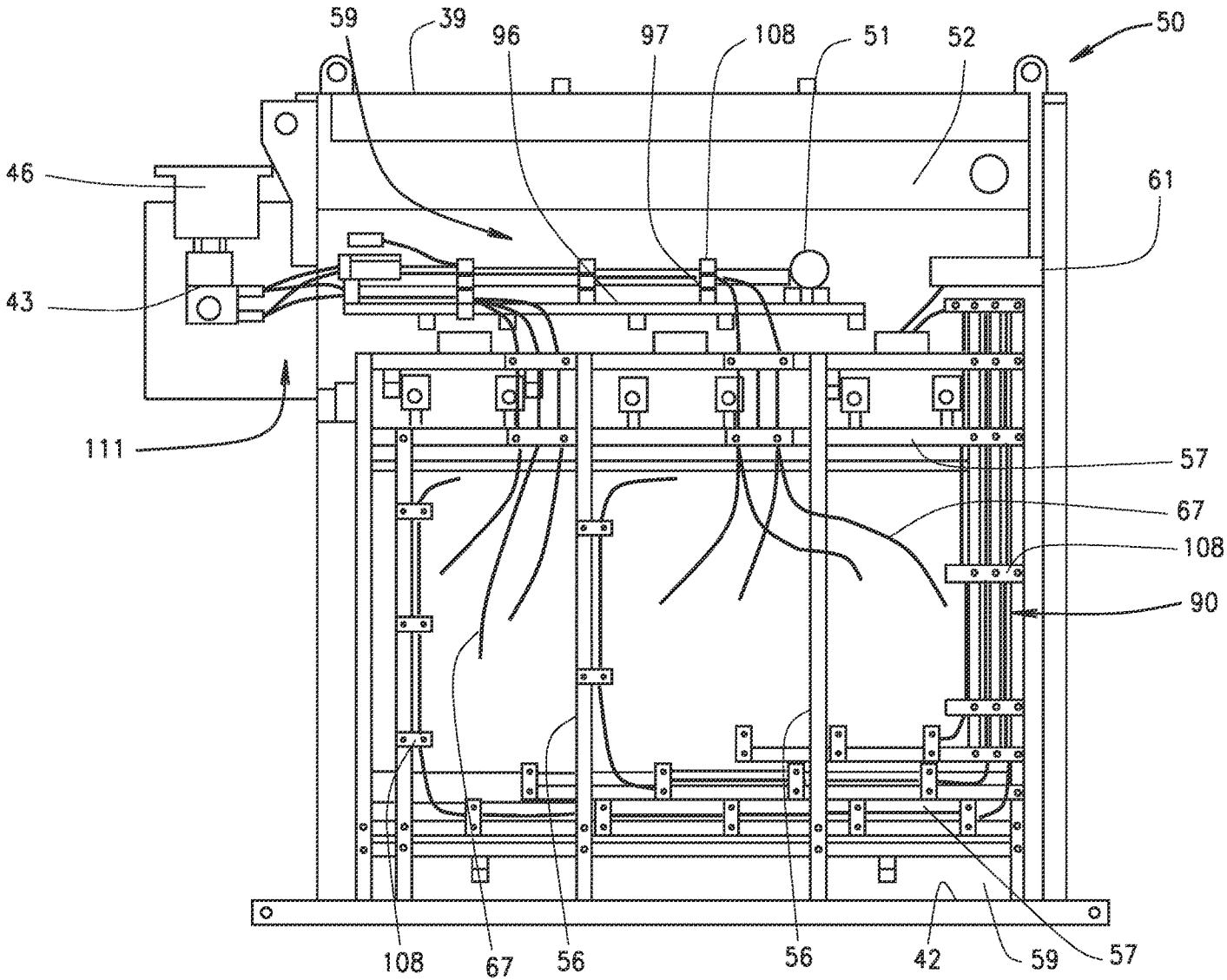
FIG. 3A is a front plan view of the power transformer showing internal electrical connections to the output terminal, according to one exemplary embodiment.
Figure 3B:
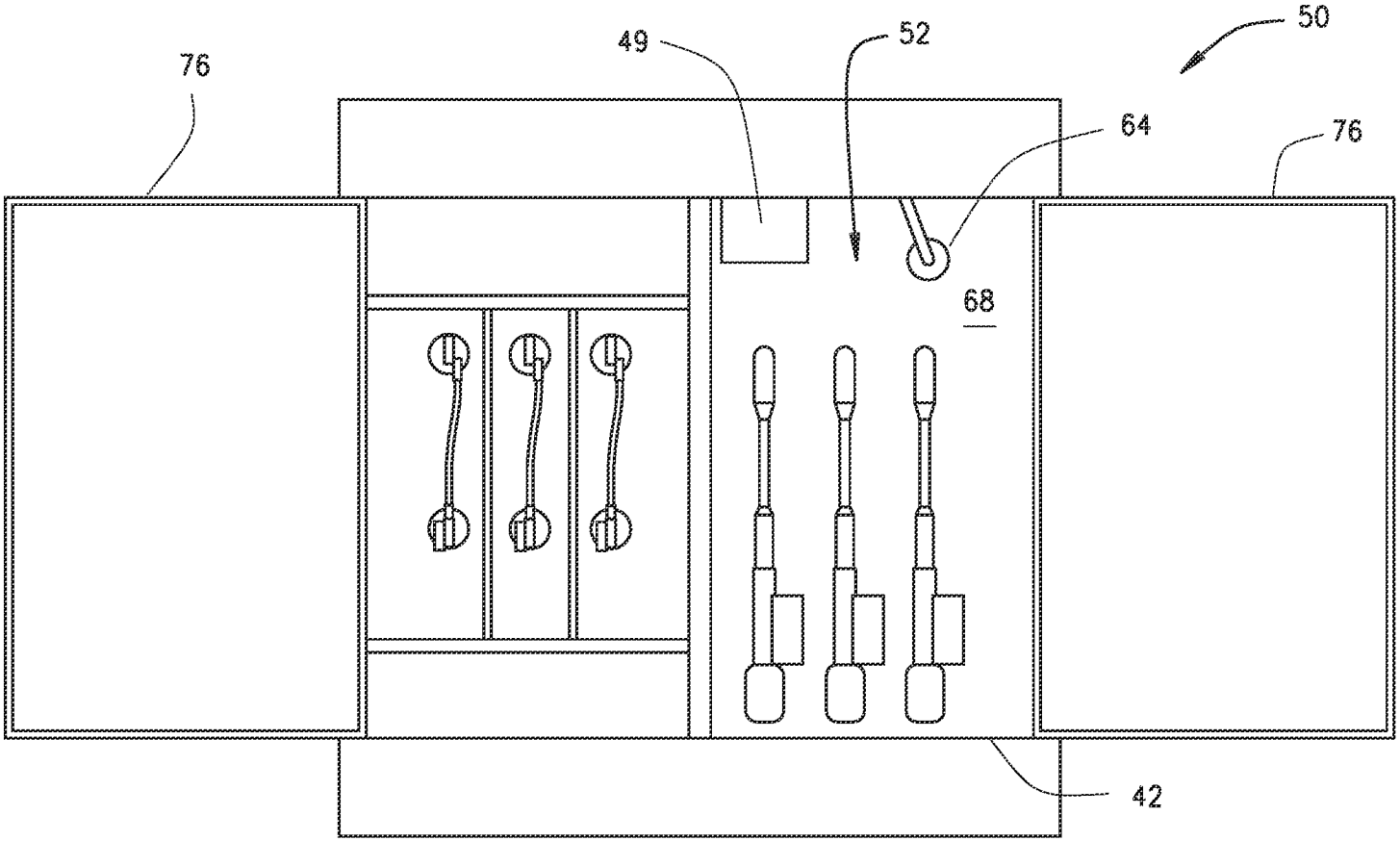
FIG. 3B is a rear plan view showing output terminal detail and the location of the potential transformers, according to one exemplary embodiment.
Figure 4:
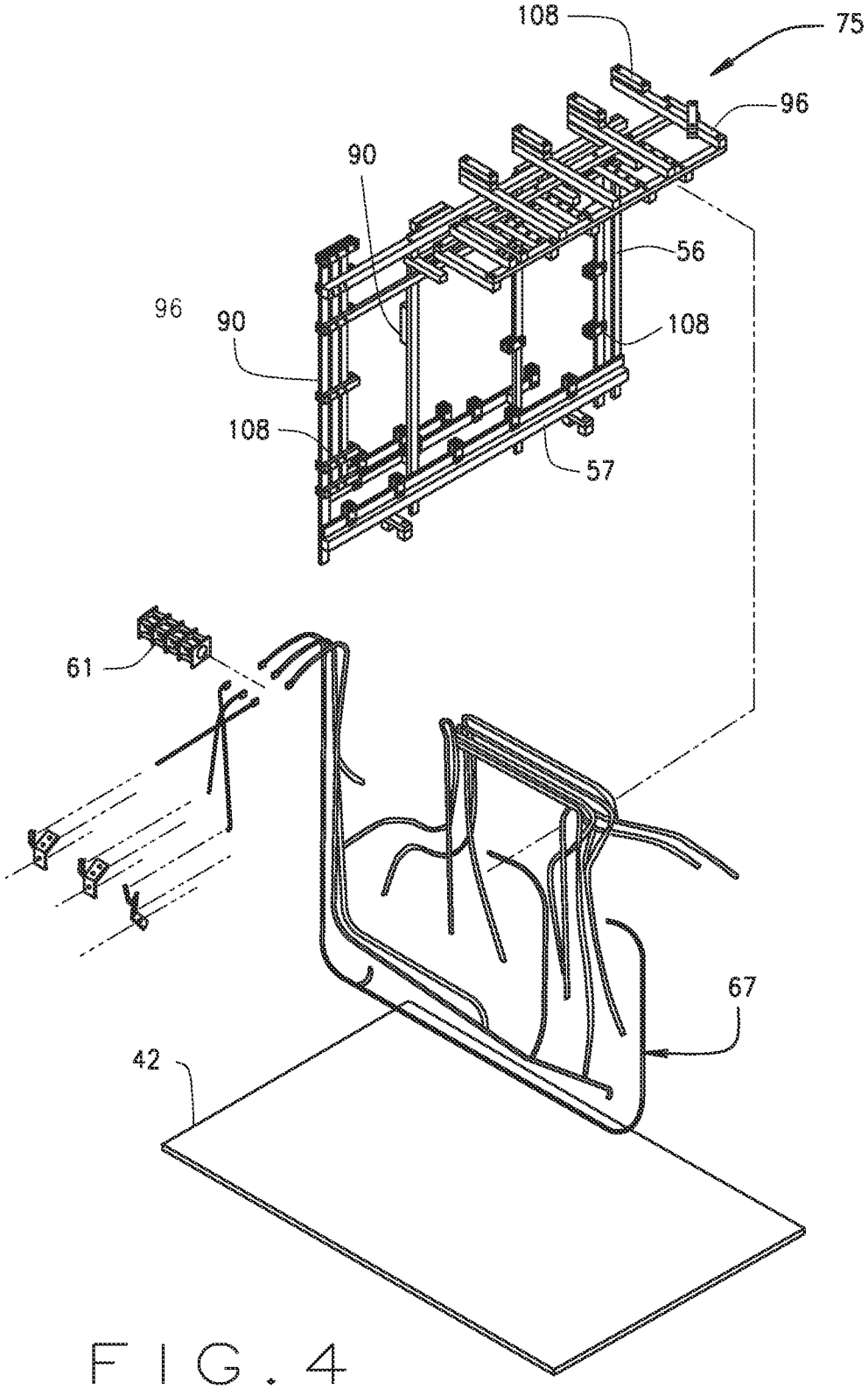
FIG. 4 is an exploded view of cable routing shown with respect to a front frame lattice of the cable routing assembly, according to one exemplary embodiment.

In one embodiment of the present disclosures, as shown in FIGS. 1A, 1B and 1C, is a pad mounted transformer 50, that includes an assembly 40 having an ECOTAP VPD load tap changer (LTC) 43 together with an LTC motor drive 46, an ECOTAP VPD Controller PRO 47 (controller) and at least one potential transformer 49 (as shown in FIGS. 2 and 3B) that serves as a monitoring device. In this disclosure, the load tap changer 43 is illustrated by example as an ECOTAP VPD on-load tap-changer that can be configured with MR's Voltage Regulator, MR's ECOTAP VPD CONTROL PRO, and MR's ECOTAP VPD MD&C motor drive, but is not limited to such a load tap changer 43.

The assembly 40 is configured to be mounted to the power transformer 50 arranged in a three-phase configuration for up to 13800 VAC. It should be understood that this shown embodiment is only exemplary and that this disclosure is intended to include all applicable transformers and embodiments. The power transformer 50 includes a principal housing 58 defining a main chamber 59, also referred to as a holding tank 59, and a rear chamber 68. As shown in this exemplary embodiment, the main chamber 59 is configured for holding three primary-secondary coil pairs 52, 55 for a three-phase power transformer configured as a triad of coils. As noted, the main chamber 59 is also a holding tank that is filled with oil 79 that often has a top oil surface 79*a*, above which within the main chamber 59 can include, in some embodiments a gas cushion 80. The gas cushion 80 typically resides above the oil 79 in the main chamber 59, the amount of which can change with changes in the temperature and during operation of the transformer 50. The oil 79 surrounds the primary coils 52 and secondary coils 55, which are commonly referred to as high voltage coils 52 or low voltage coils 55, respectively. The coils 52, 55 are typically arranged around an iron core such that the magnetic field passes through the core and strengthens the magnitude of magnetic coupling between the coils 52, 55, although, the iron core is not always necessary. The principal housing 58 includes a horizontally extending housing floor 42 on which the coils 52, 55 are mounted, and an upper ceiling or wall 39 which is shown as extending horizontally. The principal housing 58 is positioned to be exterior to the primary-secondary coil pairs 52, 55, such that the coils 52, 55, the core (if included), the installed potential transformer (PT) 49, and the LTC 43 are positioned within the principal housing main chamber 59. The motor drive 46 can also be positioned within the main chamber 59, although, as shown in FIG. 1, it can also be mounted on an exterior surface of the principal housing 58 or as otherwise may be suitable for proper operation. The power transformer 50 includes an input terminal 61 that extends into the main chamber 59 for electrically connecting to, and receiving electrical power from, an external source (shown in FIG. 2A). Power transformer 50 also can include an output terminal 64 (shown in FIG. 2A) for transmitting electrical power from the input 61, through the coils 52,55, to the output 64 to be transmitted, or distributed, to the next stage in the electrical power supply chain.

The principal housing 58 has exterior walls, including a side wall 82 such as shown in FIGS. 1A, 1B, 8 and 9. The principal or overall housing 58 includes an auxiliary housing 110, here shown by way of example as a box-like or block structure that is laterally positioned at a side of the power transformer 50, such as at the side wall 82. The auxiliary housing 110 includes an interior void or cavity referred herein as the auxiliary cavity 111. Auxiliary housing 110 in this illustrative embodiment extends from the principal housing 58, so that the auxiliary cavity 111 of the auxiliary cavity 111 opens through wall 82 via an opening, passageway or window 113 (referred herein generally as opening 113), into main chamber 59. The opening 113 provides for receiving electrical connections and further for receiving a portion of the oil 79 and, in some embodiments or situations, none or a portion of the gas 80.

Figure 9:
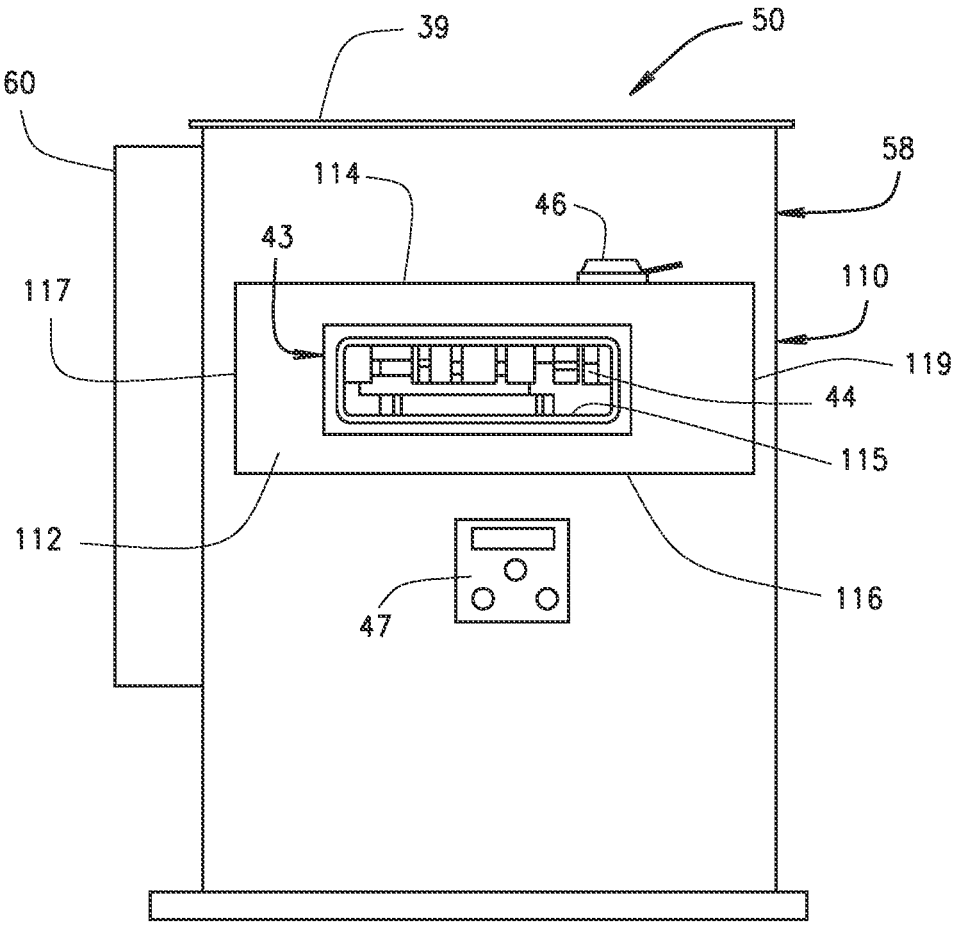
FIG. 9 is a side plan view of the power transformer with the assembly mounted to the housing of the power transformer, according to one exemplary embodiment.

Auxiliary housing 10 is illustrated to have an upper removable panel wall 114 with an interior mounting surface. The upper wall 114 preferably extends generally horizontally, and preferably is located to extend at a level beneath the level of the principal housing upper wall 39. The upper panel wall 114 has an opening 115 (as shown in FIG. 9) that is configured to facilitate mounting the tap changer 43 thereon. The opening 115 in wall 114 can have an oblong shape that conforms to the dimension of the motor drive 46. A vertical wall 112 extends between upper wall 114 and a lower housing wall 116. The auxiliary housing 110 has a rear wall 117 and a front wall 119. An access panel 124 is mounted by bolts or other suitable means on wall 112 to cover the opening in the vertical wall 112. The access panel 124 can be removed from the vertical wall 112 to allow access through the wall 112 opening 115 to the interior of the auxiliary cavity 111. The auxiliary housing 110 bottom wall 116, vertical wall 112 with cover panel 124, top wall 114, rear wall 117 and front wall 119 together form an enclosure for the auxiliary housing 110 that encloses auxiliary cavity 111 from the atmosphere surrounding the principal housing 58. The top wall 114 can be removably secured to the other auxiliary housing structures such as by bolts attaching to flanges or other structure of the vertical wall 112, and rear wall 117 and front wall 119. The opening 113 thus serves as a flow channel or conduit for flow of oil 79 from the main chamber 59 of the principal housing 58 into the auxiliary cavity 111.

The opening 113 is illustrated as basically formed with a portion of the principal housing 58, such as part of sidewall 82, omitted or removed to expose the interior of the main chamber 59 to provide a path for cables 67 to be routed from the primary and secondary coils 52, 55 through the opening 113 to switches 44 via electrical connections 109 of the LTC 43. When assembled, the auxiliary housing 110 and mounted LTC 43 are positioned so that the switches 44 extend through the opening 115 in upper wall 114 to be located within the auxiliary cavity 111 with the top surface 79*a* of the oil 79 being above the switches 44 and electrical wiring 67 (cables), such that the switches 44 are submerged in the oil 79 and not exposed to the gas 80 during operation. The auxiliary cavity 111 thus serves as a basin to surround the LTC switches 44 and connecting cables 43. A seal is formed between the switches 44 and the upper wall 114 and motor drive 46 so that when oil 79 enters from the main chamber 59 of the principal housing 58 though opening 113 to fill auxiliary cavity 111, the oil 79 does not seep or pass through the opening 115 in upper auxiliary housing wall 114 to leak outside of the auxiliary housing 110. The auxiliary housing 110 is illustrated as an example of a block of generally rectangular prism shape. However the auxiliary housing 110 can have other suitable shapes such as cubicle, trapezoidal, hemispherical, parabolic, oblong or oval, for example. In some preferred embodiments, the upper mounting surface for the upper panel 114 is generally flat. Such a surface can facilitate securing the LTC 43 thereto, and for sealing the oil 79 within the cavity 111 and chamber 59. The relationship of the auxiliary housing 110 to the housing sidewall 82 can be such that the auxiliary housing 110 is formed to be integral in whole or in part with sidewall 82. All or part of the auxiliary housing 110 can be stamped from the same sheet of metal as the sidewall 82 or otherwise to facilitate unitary structure. For example, auxiliary housing bottom wall 116, vertical wall 112, top wall 114, rear wall 117 and front wall 119 can be of suitable metal and stamped from a single sheet, then bent to fold and have edges welded to provide for a secure seal of the interior surfaces from the exterior surfaces. Alternatively, if the principal housing 58 and the auxiliary housing 110 are formed of composite or synthetic material, the auxiliary housing 110 and sidewall 82 can be integrally molded.

The primary coils 52 includes a predetermined number of coil windings (not shown) that are wound in a solenoid-like configuration. The coil windings include a plurality of load taps 53, each tap 53 represents a predetermined ratio of coil windings that is included in a coil turns ratio for making a fine adjustment to the voltage available at the output 64 of the power transformer 50. The exact number of taps 53 and the interval can vary by transformer 50, though it should be noted that the tap 53 that is selected for electrical connectivity with the input 61 can be such that the voltage in the primary coil 52 varies, for example it can vary by about 5% to about 15% above or below the rated voltage. Electrical wiring 67 connects to the taps 53 with each tap 53 having a separate wiring 67 though in FIG. 2 only 2 or 3 are shown for illustrative purposes and clarity in the drawing figure.

Figure 6A:
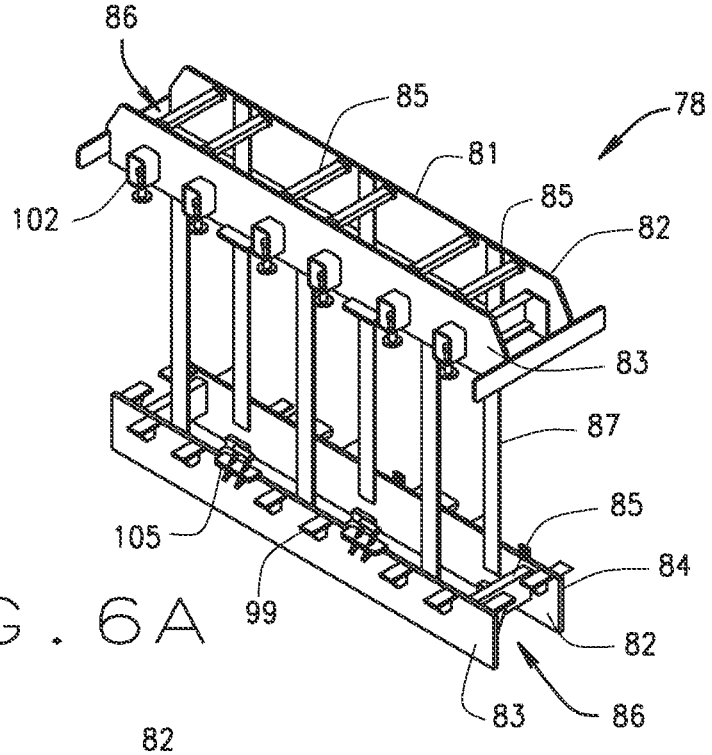
FIG. 6A is an isometric view of a frame of the cable routing assembly in an embodiment of the present disclosure.

The electrical wiring 67 within the power transformer 50 can be dense and irregular between the taps 67 and the switches 44 located in the LTC 43. In order to appropriately mount the motor drive 46 of the assembly with the LTC 43, a cable routing assembly 75 facilitates the routing of the numerous wires of the electrical wiring 67 and therefore electrical connectivity between each of the taps 53 of the primary coil 52 with the LTC 43, and also connections to the potential transformer 49, the motor drive 46, and the secondary coil 55. The cable routing assembly 75 includes a plurality of frame components includes a lattice frame 78. The cable routing assembly 75 can be connected together in a cage-like configuration wherein the cage-like lattice frame 78 includes a top bracket 81, a bottom bracket 84, a plurality of connecting beams 87 extending between the top and bottom brackets 81,84, front and rear cable routing panels 90,93, (front bracket 90 shown in FIGS. 1A, 1B, and 10 and back bracket shown in FIG. 3A), a top cable routing panel 96, coil supports 99, and plurality of top and bottom clamping features 102,105 (top clamping feature 102 as shown in FIG. 6B, and bottom clamping feature 105 as shown in FIG. 6A).

Figure 5A:
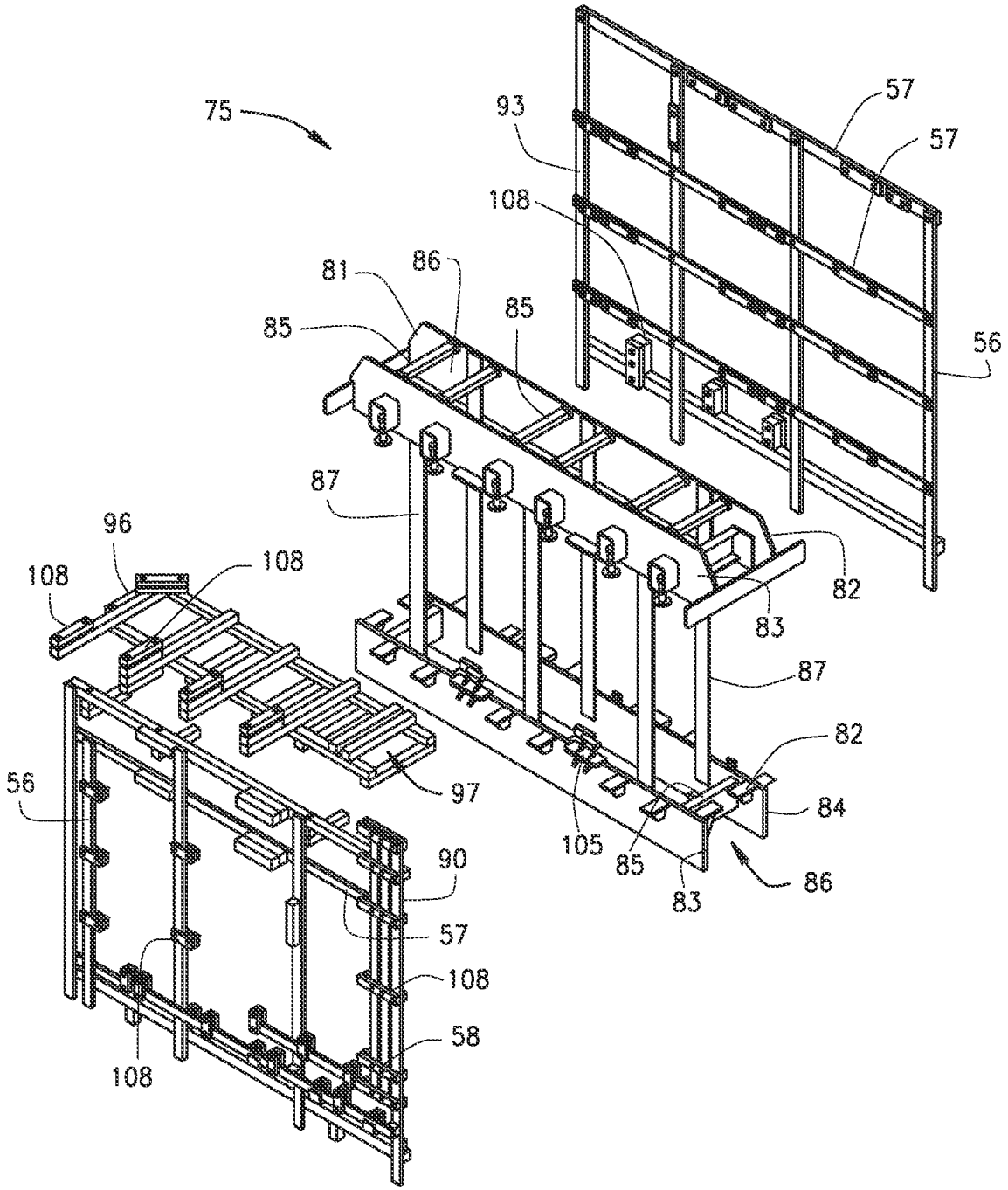
FIG. 5A shows an exploded view of the cable routing assembly with the frame imposed between the front, top, and rear lattices, according to one exemplary embodiment.
Figure 5B:
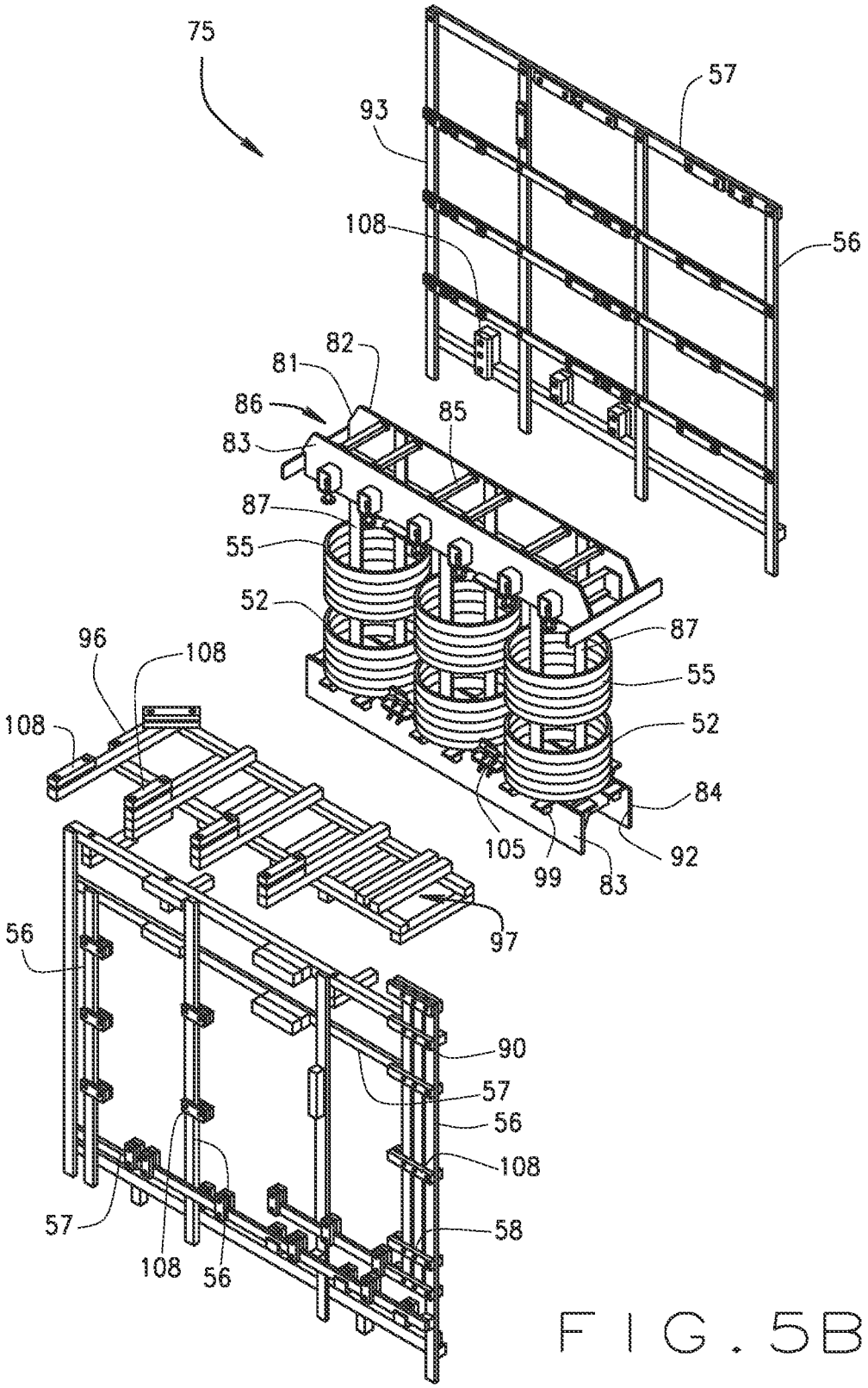
FIG. 5B shows an exploded view of the cable routing assembly with the frame supporting the coils imposed between the front, top, and rear lattices, according to one exemplary embodiment.
Figure 6B:
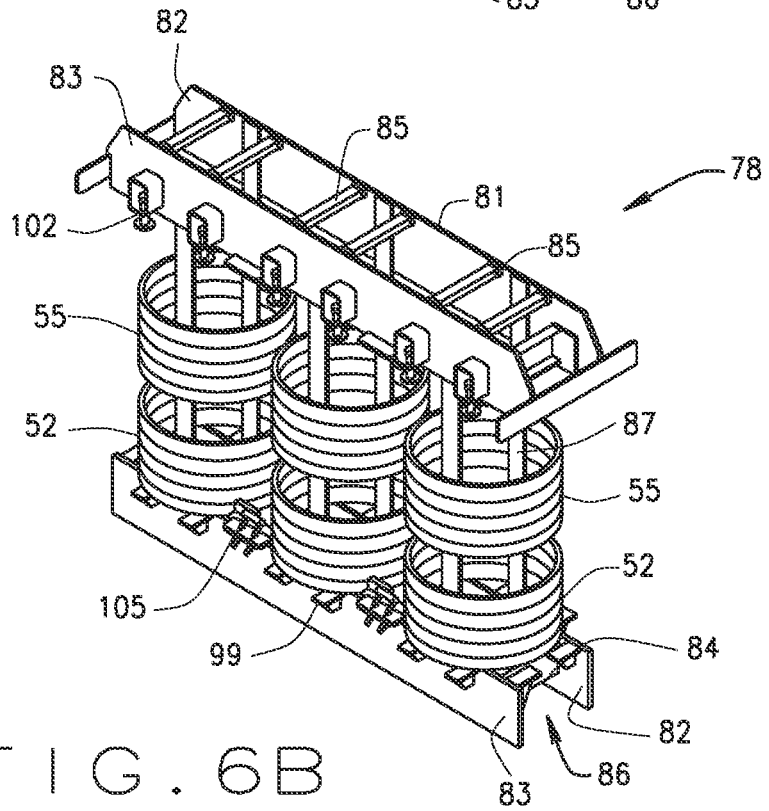
FIG. 6B is an isometric view of power transformer coils mounted thereon in an embodiment of the present disclosure.

As shown in FIGS. 5A, 5B, 6A, and 6B, the top and bottom brackets 81, 84 are generally mirrored about a horizontal plane positioned therebetween and are composed of opposing side members 82, 83 fixed relative to each other. The opposing side members 82, 83 are spaced apart from each other with a plurality of cross beams 85 extending across a channel 86 defined between the opposing side members 82, 83, thereby fixing the opposing members 82, 83 in position relative to each other. Extending between the top and bottom brackets 81, 84 are the plurality of pairs of vertical beams 87. Each pair of beams 87 is positioned such that the primary coils 52 and secondary coils 55 will wrap around them, as shown in FIG. 6B.

In the assembled configuration, the components of the cable routing assembly 75 are connected to support the coils 52, 55 and to effectively route the tap electrical wiring cables 67 around the coils from the taps 53 to the LTC 43.

Figure 7:
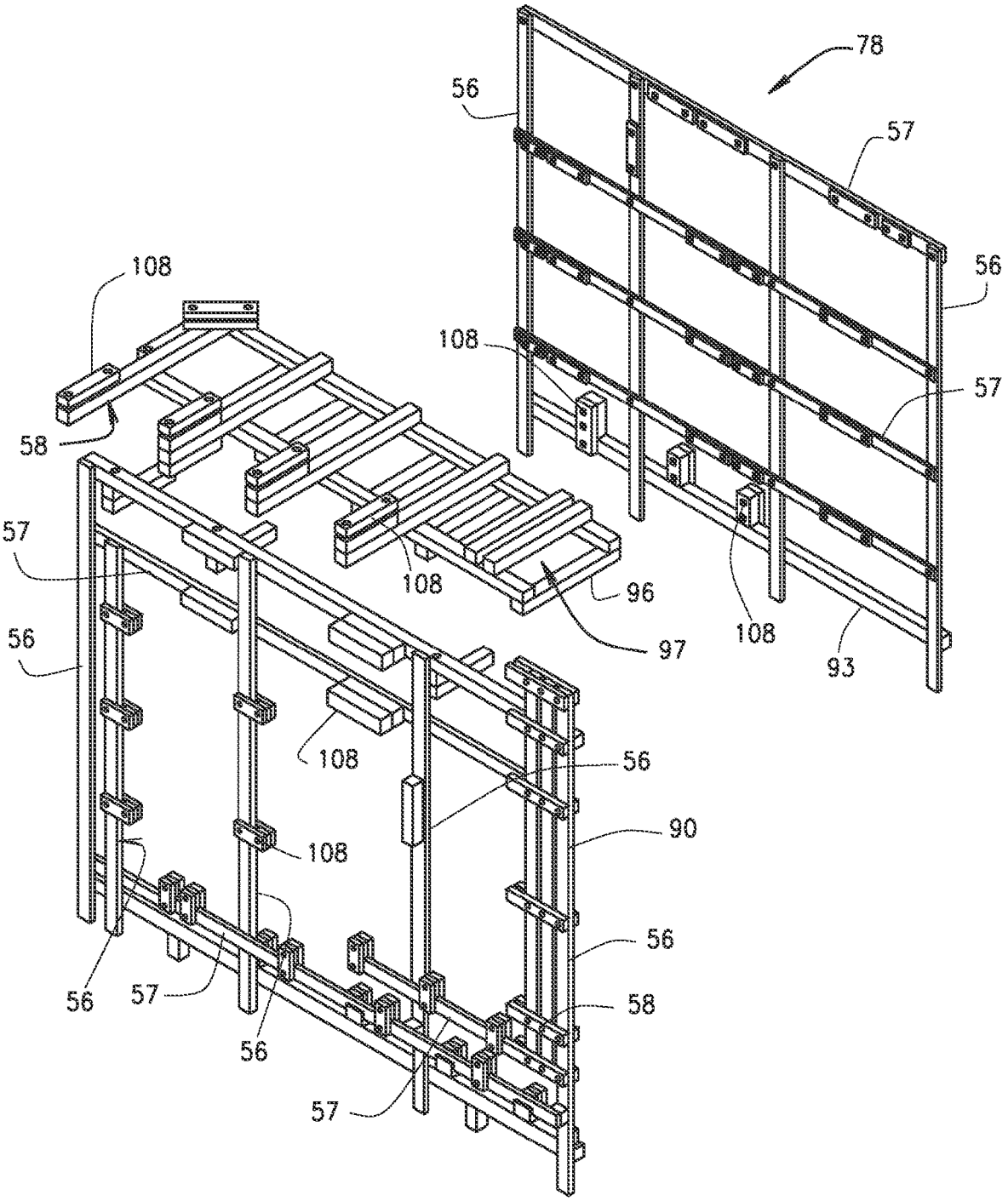
FIG. 7 shows front, top, and rear lattices of the cable routing assembly, according to one exemplary embodiment.

The cable routing assembly 75 also includes front and rear routing panels 90, 93 have a generally rectangular cross-like configuration, as shown in FIGS. 5A, 5B and 7. The panels 90, 93 are configured with crossing generally horizontal beams 57 and generally vertical beams 65 that are connected in a lattice, cross-like configuration. The material used for the vertical and horizontal beams 56, 57 can be made of a non-conducting material that provides electrical insulation, heat resistance, and stress resistance such as a composite or wood. In particular, as this cable routing assembly 75 is immersed within the oil 79 in the main chamber 59 holding the coils 52, 55, the material must be suitable for such operational use. In one embodiment, the beams 56, 57 are made of a pressure treated wood material, having properties such as electrical insulation, heat resistance, and stress resistance. The vertical beams 56 on both the front and rear panels 90, 93 are positioned at intervals, partitioning the panels 90, 93 approximately into thirds. The horizontal beams 57 on the front panel 90 are positioned at the top and bottom, respectively. Along the horizontal beams 57, each of a plurality of routing cleats 108 is positioned at intervals generally aligning with the positioning of the vertical beams 56. The vertical beams 56 are fixed at intervals with similar routing cleats 108 positioned at approximate thirds along the height. The routing cleats 108 are designed in a stack-like configuration with slots 58 passing through the stack where cables 67 are routed. Cables 67 are connected to the taps 53 on the coils 52, respectively, can be routed along the vertical beams 56, through the vertical cleats 108, to the cleats 108 positioned on the horizontal beams 57 and then routed towards the opening 113 of the main chamber 59 to the switches 44 located within the auxiliary cavity 111.

The vertical beams 56 on the front panel 90 can be arranged as groups of triples with the spacing therebetween creating a routing channel for the cables 67, as best shown in FIGS. 6A, 6B. In this configuration, the cables 67 can be effectively routed from the taps 53 on the primary coil 55 through the cleats 108 to the top panel 96, and then routed by the top panel 96 to the LTC 43.

The rear panel 93 is preferably configured symmetrically about the horizontal beams 57 and vertical beams 56 similar to the front panel 90. A plurality of vertical and horizontal routing cleats 108 are positioned on the rear panel 93, as shown in FIG. 5B and FIG. 7. The routing cleats 108 are positioned to route the cables 67 from the taps 53 on the opposite sides of the coils 52 to the top panel 81 before being routed to the LTC 43.

The top panel 96 is positioned generally horizontally above the top bracket 81, extending along the length of the horizontal beams 57 of the front and rear panels 90, 93 respectively. The top panel 96 has horizontal routing cleats 108 that are fixed in a stack-like configuration with pass through slots 97 for routing the cables 67 horizontally towards the LTC 43 as they are received from the vertical routing cleats 108 on the front and rear panels 90, 93. The cables 67 are routed along the tops of the coils 52, 55 until they terminate in an electrical connection 109 at the switches 44 of the LTC 43 located within the auxiliary cavity 111.

In some embodiments, the cable routing assembly 75 is dimensioned and positioned within the main chamber 59 such that it is entirely submerged and covered by the oil 79 within the main chamber 59. In some embodiments, all electrical wires 67 between the taps 53 and the switches 44 as routed by the cable routing assembly 75 are submerged and covered by the oil 79.

As discussed above, the principal housing 58 can include auxiliary housing 110 shown as a box-like structure or block that is positioned at a top portion of the principal housing 58, such as at a side by way of example. As discussed, the auxiliary housing 110 is shown here to have an interior void or cavity 111. Auxiliary housing 110 is positioned to extend from the overall housing 58, so that the auxiliary cavity 111 opens through the opening 113 into main chamber 59 so that the oil 79 in the main chamber 59 flows and fills the auxiliary cavity 111 as well. After draining at least some if not all of the oil 79 within the auxiliary cavity 111 and of course the main chamber 59 that is fluidly connected thereto, the access panel 124 can be removed from the vertical auxiliary housing wall 114 to allow access through the opening to the interior of the auxiliary cavity 111 for installing the LTC 43 or otherwise adjusting or handling of the LTC 43. The opening 113 is basically formed with a portion of the principal housing 58 omitted or removed to expose the interior of the main chamber 59 to provide a path for cables 67 to be routed from the primary and secondary coils 52,55 through the opening 113 to connect to switches 44 of the LTC 43 and for the oil 79 to also fill the auxiliary cavity 111 to submerge the switches 44. At such a level, the level of oil 79 within main chamber 59 will rise to a level that at least is along the lower surface of auxiliary housing upper plate or wall 114 so as to submerge the switches 44. The level of the upper surface layer 79*a* in the main chamber 59 can be above the level of the oil 79 within auxiliary cavity 111. Thus when the oil 79 is placed within the main chamber 59 it should be at a surface layer 79*a* level that will allow the oil surface level 79*a* to submerge the switches 44 even when the oil 79 contracts to the lowest potential level of the surface 79*a*. That lowest potential level is determined by expected operating conditions and climate of the installation location.

Figure 10A:
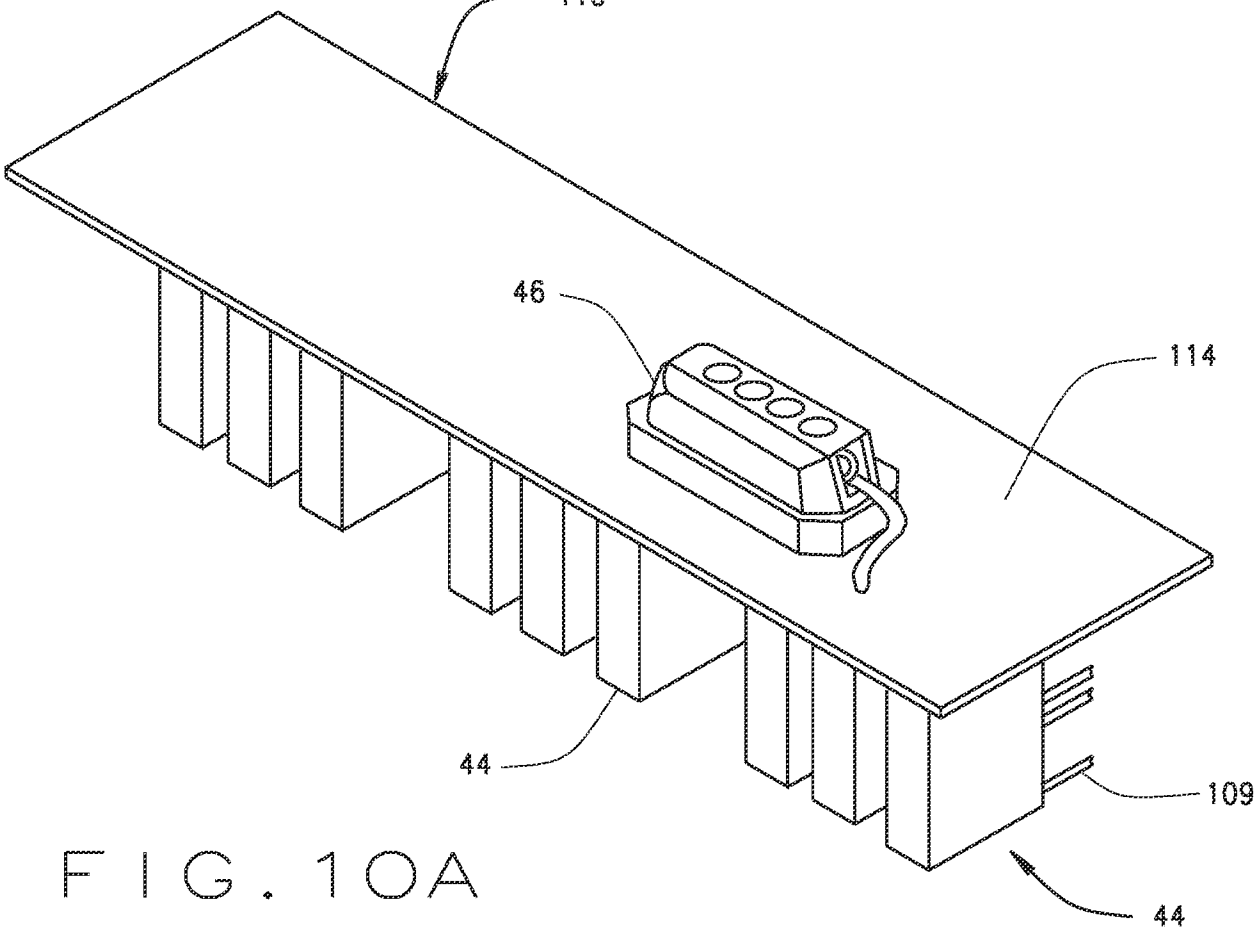
FIG. 10A is an isometric view of the mounting of an embodiment of the assembly of ECOTAP VPD LoadTap Changer on the auxiliary housing.
Figure 10B:
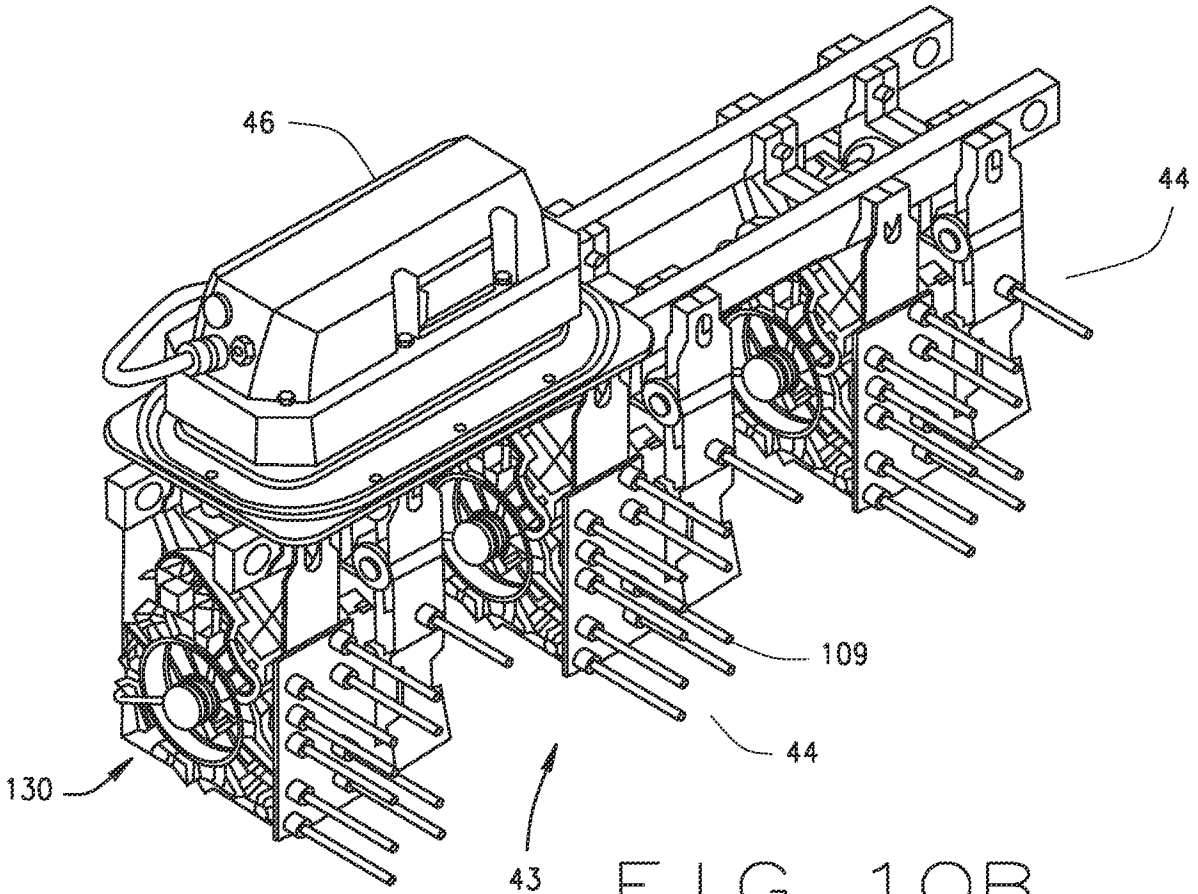
FIG. 10B is an isometric view showing the mounting detail of an embodiment of the assembly of ECOTAP VPD LoadTap Changer.
Figure 10C:
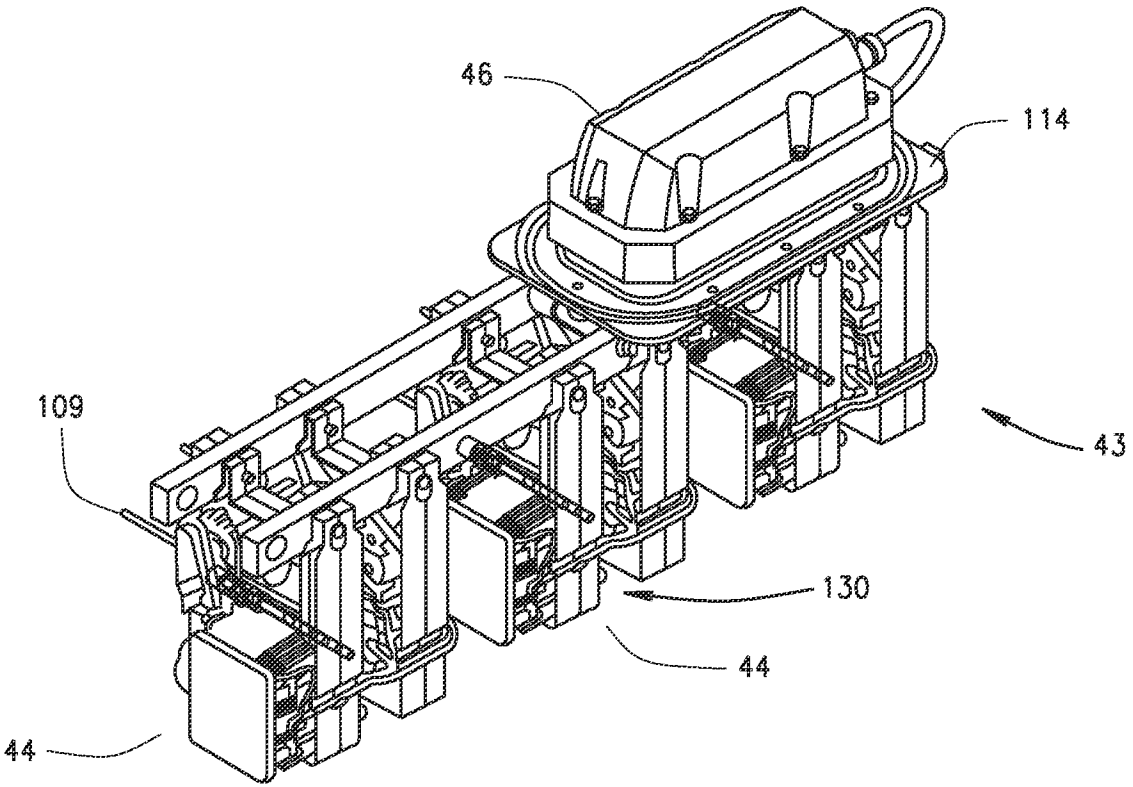
FIG. 10C is an isometric view showing the mounting detail with electrical connection pins of the assembly of ECOTAP VPD LoadTap Changer, according to one exemplary embodiment.

The cables 67 terminate at the switches 44 of the LTC 43, which is mounted on the interior surface of the upper wall 114 of mounting auxiliary housing 110 near a top of the power transformer 50. At the mounting position, the LTC 43 is mounted proximate to the LTC controller 47, such that they can be electrically connected and secured in fixed positions relative to each other, as shown in FIGS. 10A, 10B, and 100. As shown, the LTC motor drive 46 is mounted on an external surface of the upper wall 114 of auxiliary housing 110, while the LTC 43 is mounted proximate to the LTC motor drive 46 on the interior surface of the upper wall 114 of mounting auxiliary housing 110 directly adjacent to the pass through opening 113, such that the electrical connections 109 and cables 67 are routed through opening 113, as seen in FIG. 100. On the exterior surface of the upper wall 114 of auxiliary housing 110, directly above the LTC 43, the LTC motor drive 46 is mounted such that the electrical connections 109 are able to pass through the aforesaid opening 115 in the upper wall 114. In this configuration, the LTC 43 with its motor drive 46 and switches 44 can be installed on the power transformer 50 during initial assembly, or they can be added at a time after the power transformer 50 is installed. The LTC 43 with its motor drive 46 and switches can be mounted in this configuration, or can be mounted in an alternative configuration, such that the LTC 43, the motor drive 46 and the switches 44 are mounted on an interior surface of the auxiliary housing 110, on an exterior surface of the mounting auxiliary housing 110, or in an assembly such that both the LTC 43 and the LTC motor drive 46 are electrically connected to power transformer 50 through a self-contained assembly that can be attached to the exterior of the power transformer 50. However, as noted, the switches 44 and the electrical connections 109 of the wires 67 are configured to be positioned within the auxiliary cavity 111 such that when the main chamber 59 is filled with oil 79 they are and remain submerged below the top surface 79*a* of the oil 79.

With reference to FIGS. 2A,B and 3A,B, the electrical connectivity from the input 61 of the power transformer 50 through the internal components to the output 64 includes electrical wiring 67 connected between the internal components for facilitating proper power transformer 50 operation. The path that electricity follows starts with the input 61, through the primary coil 52, and is provided as an input to the LTC 43. The LTC 43 is connected to a selectively electrically coupled to one of the plurality of taps 53 on the primary coil 52 of the power transformer 50 where an alternating current (AC) is transmitted. An output of the LTC 43 is connected to the selected tap 53 of the primary coil 52 wherein the tap 53 that is selected adjusts the level of magnetic coupling between the primary coil 52 and the secondary coil 55. The induced magnetic field in the secondary coil 55 creates an induced alternating current (AC), as well as a voltage across the secondary coil 55. The output voltage of the secondary coil 55 is monitored by the PT 49 which is configured to measure this induced voltage of the secondary coil 55 and to sale the measured induced voltage and then generate a scaled measured voltage value 70 and provide such to an input of the LTC controller 47.

In operation, the AC voltage input at terminal 61 of the primary coil 52 is constantly changing, thereby inducing a constantly changing magnetic field surrounding the secondary coil 55. The secondary coil 55 is positioned within the constantly changing magnetic field and is experiencing the effects of the constantly changing magnetic field, consequently realizing an induced AC in the secondary coil 55. The induced AC also includes an induced voltage on the secondary coil 55, whereby an electrical potential exists across the positive and negative terminals 71, 72 of the secondary coil 55. The positive side 71 of the secondary coil 55 is electrically connected to the output terminal 64 and to the input of the potential transformer PT 49. The output terminal 64 transmits the electrical power to the next stage in the electrical power supply chain, or distributed to the distribution line where it can be further distributed to the end users. The output at output terminal 64 of the potential transformer 49 is electrically connected to input of the LTC controller 47 for transmitting the scaled measured value 70 that represents the potential across the secondary coil 55. Upon receiving the scaled measured value 70 that represents the voltages across the secondary coil 55, the LTC controller 47, is configured to determine if the voltage is in an acceptable range. If the voltage is not within the acceptable range, the LTC controller 47 is configured to generate and transmit a tap adjustment message 73 to a control input of the LTC 43 that is indicative of the LTC controller 47 determined appropriate tap selection. Upon receipt of the tap adjustment message 73, the LTC 43 is configured to generate a motor control message 74 to control the motor 46 for adjusting the bank of switches 44 (FIG. 2B, connecting to the selected tap 53). This change in the selected tap 53, results in an adjusted winding ratio available for magnetic coupling. The LTC 43 signals via motor control message 74 the motor drive 46 to adjust its position thereby connecting to an adjusted tap on the primary coil 52.

The primary coil 52, and the secondary coil 55 each includes a predetermined number of coil windings that are wound in a solenoid-like configuration, which can also be similarly selected via a tap 54 of the secondary coil 55. The coil windings include a plurality of secondary taps 54, each tap 54 representing a predetermined ratio of coil windings that is included in a coil turns ratio for making a coarse adjustment to the voltage available at the output 64 of the power transformer 50. In some embodiments, the changing of the secondary taps 54 on the secondary coil 55 can only be performed when the input power at terminal 61 is disconnected as the power on the secondary coil taps 54 can be significant. However, if the power levels and the technology of the tap changer 43 enables for the automated changing of the taps 54, the secondary coil 55 could also be equipped with a secondary tap changer 45, Type De-Energized (DETC) tap changer, which can be configured to provide coarse adjustments to an energized secondary coil 55 in some embodiments.

Referring to FIG. 2B, the ECOTAP VPD Controller PRO 47 is electrically connected between with the Load Tap Changer 43 and the potential transformer 49. The controller 47 is configured to monitor the scaled measured signal 70 as provided by the PT 49. The controller 47 is configured with a plurality of inputs for external communication, including a remote input 48, a manual override input 51, and a COM port 62 for configuring and programming the controller 47. The output of the controller 47 is connected to the motor drive 46 of the LTC 43 to provide the motor control 74. The LTC 43 includes a bank of switches 44, which is adjusted by the motor drive 46 to electrically connect the selected tap 53 as provided in motor control message 74 from the controller 47 for selection a single one of the plurality of secondary taps 54 on the primary coil 52. The electrical leads 109 at the output of the LTC 43 are electrically connected via electrical wiring 67 to the secondary taps 54 on the primary coil 52, as shown in FIG. 2B, where the electrical cabling 67 is routed therebetween using the cable routing facility 75 and in particular the lattice frame 78, as shown with reference to FIG. 8.

Referring now to FIGS. 3A and 3B, the power transformer 50 is split into the two separate chambers 59, 68, with a dividing wall 52 positioned to separate the two. The main chamber 59 of the principal housing 58 houses the primary and secondary coils 52, 55, and the auxiliary cavity 111 of the auxiliary housing 110 houses the LTC 43, and the LTC controller 47. The rear chamber 68 is covered by a rear panel 60, which can be opened to expose the interior by a pair of doors 76. When the doors 76 are in the opened position, the potential transformer 49 and the output terminal 64 are exposed for access. The potential transformer PT 49 is positioned in the rear chamber 68 with an electrical communication between the main chamber 59 and the rear chamber 68 of the power transformer 50, through openings in the dividing wall 52, with the electrical wiring connecting the terminals of the primary coil 52 to the potential transformer 49 and the output terminal 64 of the power transformer 50.

Once the determination that an adjustment in the turns ratio to be included in magnetic coupling has been made, the controller 47 is configured to transmit an adjustment message 74 to the LTC 43 thereby controlling the motor 46 that selects from the switch bank 44 the selected tap 53 of the primary coil 52*g*.

In the event that an adjustment in the selected tap 53 in the LTC 43 needs to be made, the controller 47 and the LTC 43 are configured to electrically communicate the adjustment message 74 between them. The LTC 43, upon receiving the adjustment message, is configured to electrically connect to the selected tap 53 prior to disconnecting the previous tap 53. This transition between the selected tap 53 and the previous tap 53 is done to enable a gradually transition so that the adjusted voltage level associated with the updated tap 53, is smoothed and does create outages or spikes. This transition occurs in a gradual manner such that the transition to the selected tap 53 is adjusted while simultaneously supplying electrical power continuously without interruption. When this occurs, the supply of electrical power to the consumers on the distribution lines continues without an observable interruption, appearing to be automatic without the need to take the power transformer 50 offline.

Figure 10E:
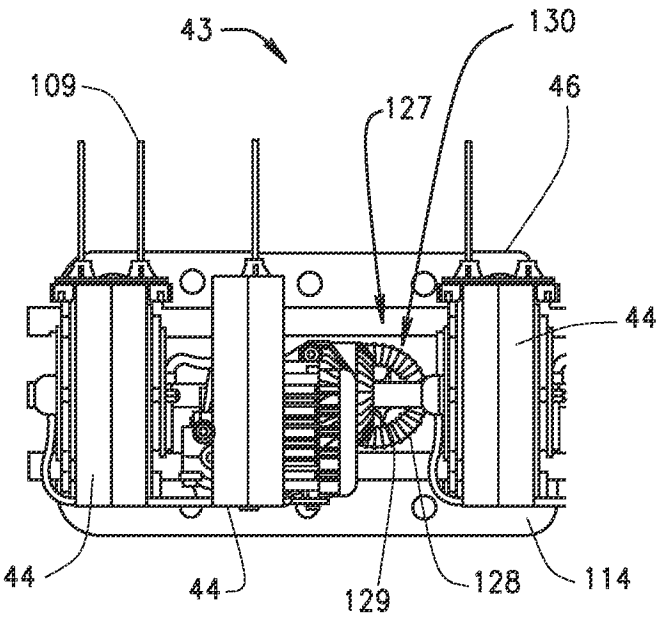
FIG. 10E is a bottom plan view of the gear assembly of the motor drive that adjusts the tap position, according to one exemplary embodiment.
Figure 10D:
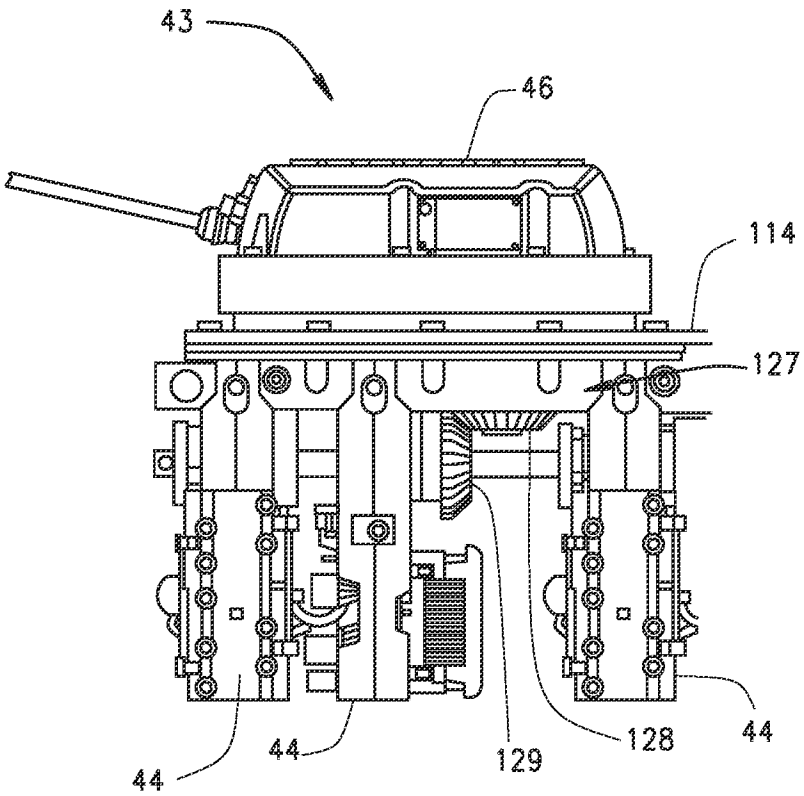
FIG. 10D is a side isometric view of the gear assembly of the motor drive that adjusts the tap position, according to one exemplary embodiment.

Referring to FIGS. 10D and 10E, the LTC 43, with the motor drive 46, includes a gear assembly 127 for rotating and adjusting the taps 53 on the primary coil 52 that are connected for magnetic coupling with the secondary coil 55. The motor drive 46 includes a first beveled gear 128 that rotates about a vertical axis extending perpendicularly from the bottom surface. The first beveled gear 128 meshes with a second beveled gear 129, which rotates about an axis parallel to the bottom surface and perpendicular to the vertical axis, as shown in FIG. 10D. When the PT 49 transmits a reference value 70 that indicates an adjustment is needed, the ECOTAP VPD 43, 46 can automatically adjust the position of the taps 53 via rotating the rotary gears 130 to adjust the tap 53 that is connected to the electrical leads 109. Alternatively, the position of the rotary gear 130 can be adjusted manually by an external input from the VPD Control PRO 47.

Additionally, the electrical connectivity between the potential transformer 49 and the LTC motor drive 46, where the representative value 70 of the electrical potential across the secondary coil 55 is electrically communicated, can be positioned to pass from inside the auxiliary housing 110 to the inside of the main chamber 59 the principal housing 58 through the pass through opening 113.

Figure 8:
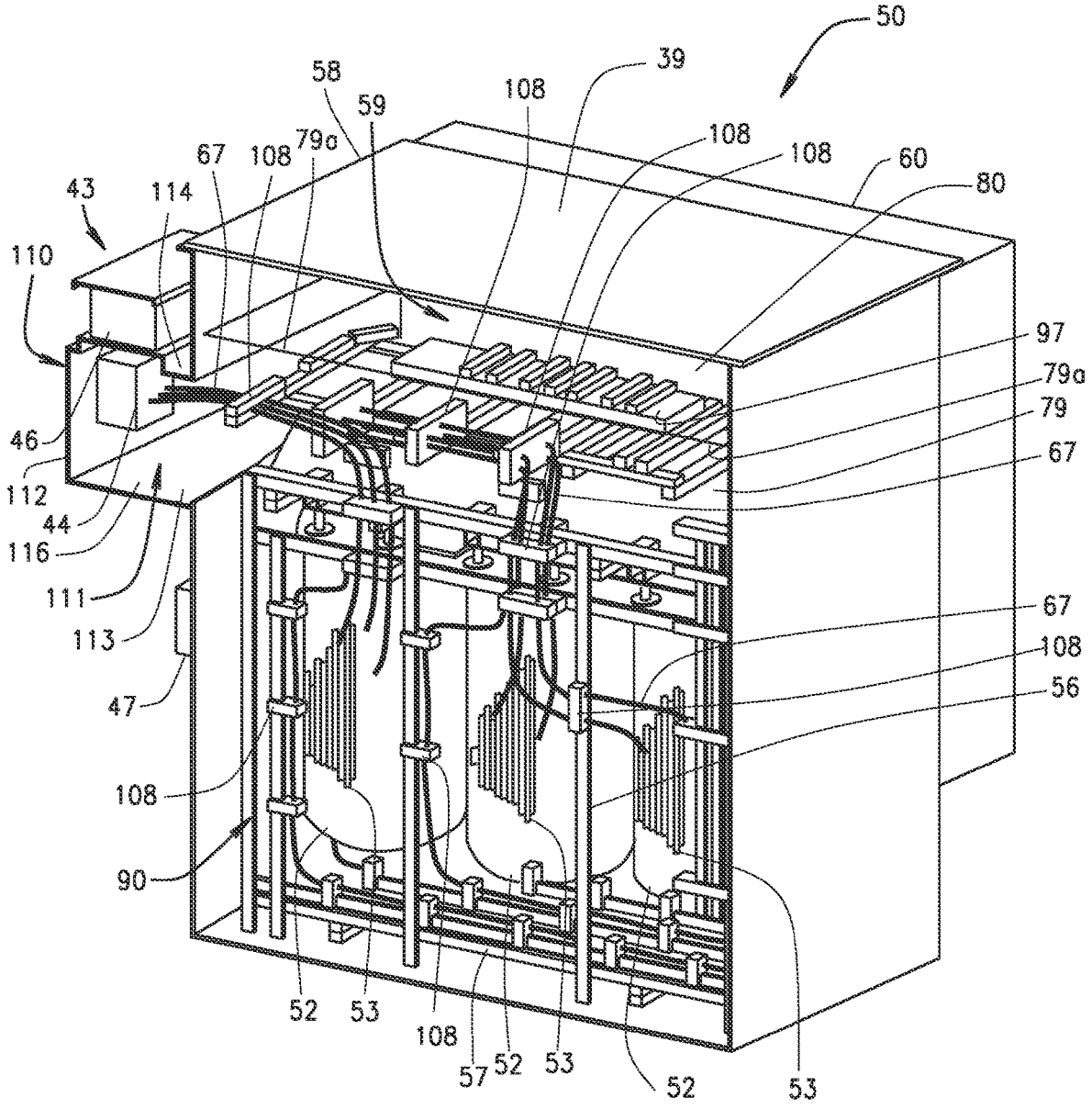
FIG. 8 shows an alternative front isometric view of a power transformer of an embodiment of the present disclosure.

In FIGS. 1A, and 8 the upper wall 114 of auxiliary housing 110 is shown to have an inverted channel shape with the central part stepped up or raised above an outer perimeter flanged section, while is FIGS. 10A-10D the upper wall 114 is generally flat. Other suitable configurations for the upper wall 114 can also be provided.

The mounting of the LTC 43 is illustrated by the auxiliary housing 110 which projects laterally or horizontally from housing wall 82. Such structure has the advantage of providing positioning so that the oil 79 can flow into the auxiliary cavity 111 to surround the switches 44 with a minimum amount of oil 79 having to be provided for that purpose. Alternatively, the structure could be configured so that the auxiliary housing 110 or at least the auxiliary housing bottom 116, rather than being positioned well above the housing floor 42 as shown in FIGS. 1A and 8, could be coextensive with the housing floor 42. Such a structure would require much more oil 79 to fill the space between the auxiliary housing or compartment upper wall 114, since the volume of such space would be much greater in view of the height of the of extension from floor 42 to the upper wall 114 being much greater, so that the required volume would be considerably great than the volume of the auxiliary housing 110 depicted in the drawings. Hence the design picture in the drawings is preferred over that wherein the bottom of the compartment extend to the floor 42 and the height of the upper wall 114 being the same as shown in the drawings. Such an alternative design would increase the overall width of the principal housing 58 from top to bottom and take up more floor or pad space. Such an alternative design would nevertheless provide the advantage of the upper oil level 79*a* within the main chamber 59 being positioned to be at least the same height as, or above, the LTC switches 44. Moreover, the width of the auxiliary housing bottom wall 116, vertical wall 112, top wall 114, can vary so that if desired end walls 117 and 119 of box 110 can be coextensive with the front and rear walls of the principal housing 58.

The auxiliary housing upper wall 114 and lower wall 116 are illustrated as preferably horizontal and parallel to one another, and the wall 112 is illustrated as preferably vertical. However the upper and lower walls 114 and 116 could be slanted from horizontal to some degree, and the vertical wall 112 slanted for the vertical, or of different widths to have a trapezoidal like appearance.

Another alternative design is mounting the LTC 43 so as to extend through an opening in a main housing side wall, such as a side wall 82, with the LTC 43 switches 44 projecting inwardly through said opening in sidewall 82, In that case the motor drive 46 would be mounted to the outside of side wall 82 such as it as shown mounted to auxiliary housing wall 114, with the switches 44 below the oil 79 upper surface level 79*a*, and the switches 44 and oil 79 sealed off from the motor drive 46 such as earlier described for the mounting with auxiliary housing or compartment 110. However, the designs illustrated in the present drawings are preferable in many embodiments because of greater facility in connecting the LTC leads, in mounting the LTC 43 and motor drive 46, and in accessing the switches 44 and leads.

In view of the above, it will be seen that the disclosures provide several advantages.

All patents, patent applications, operating instructions and literature mentioned herein are hereby incorporated by reference.

As various changes could be made in the above constructions without departing from the scope of the invention, it is intended that all matter contained in the above description or shown in the accompanying drawings shall be interpreted as illustrative and not in a limiting sense.

The invention claimed is:

1. A power transformer assembly configured for supplying electrical power to at least one consumer, comprising:

a power transformer having an input terminal configured to connect to and receive alternating electrical current from an external source;

a principal housing having a main chamber and a rear chamber, with the main chamber configured for receiving at least one high voltage coil and retaining oil surrounding the at least one high voltage coil, an auxiliary housing configured on an outer portion of the principal housing defining a cavity that is fluidly connected to the main chamber via a passageway that is configured for receiving electrical wiring, the at least one high voltage coil having a plurality of taps associated with a range of winding ratios, the at least one high voltage coil connected to the external source through the input terminal, at least one low voltage coil positioned adjacent to the at least one high voltage coil and connected to an output terminal of the power transformer to be capable of supplying electrical power to at least one customer, where an electrical current can be induced in the at least one low voltage coil from a magnetic coupling with the ratio of windings associated with a selected tap from said plurality of taps of the at least one high voltage coil when the external source supplies alternating current to the input of the power transformer:

a potential transformer configured for connection to the output terminal of the power transformer to measure an electrical potential on the at least one low voltage coil, the potential transformer configured to generate a measured value indicative of the electrical potential across the at least one low voltage coil;

a load tap changer having a controller, a motor and a plurality of switches each with one or more connectors/terminals configured to connect to electrical wiring connected to each of the plurality of taps on the at least one high voltage coil of the power transformer, the plurality of the switches being positioned within the auxiliary housing cavity to be submerged by the oil in the main housing chamber, the load tap changer configured to adjust the connected tap associated with a ratio of total windings in the at least one high voltage coil to be included in magnetic coupling;

a load tap change controller having at least one input configured to electrically couple to the potential transformer, wherein the load tap changer is configured to determine the electrical potential across the at least one low voltage coil based upon the measured value from the potential transformer and upon detecting an unacceptable electrical potential across the at least one low voltage coil, is configured to adjust the ratio of total windings in the at least one high voltage coil available for magnetic coupling with the at least one low voltage coil of the power transformer, and configured to adjust the electrical potential induced in the at least one low voltage coil;

wherein the load tap change controller is configured to adjust the connected tap associated with the ratio of windings available for magnetic coupling such that during adjustment, the switches and electrical connections of the tap electrical wiring are submerged in the oil of the main chamber and the auxiliary housing cavity, the magnetic coupling can be shifted and simultaneously provide a continuous supply of electrical power to the consumer.

2. The power transformer assembly of claim 1, wherein the first load tap changer associated with the at least one high voltage coil is configured for adjusting the ratio of the at least one high voltage coil available for magnetic coupling with the adjacent at least one low voltage coil; and wherein each successive tap on of the at least one high voltage coil is configured to induce a fine adjustment in the induced magnetic coupling with the adjacent at least one low voltage coil, thereby configured for making a fine step in voltage available to the output of the power transformer.

3. The power transformer assembly of claim 2, wherein the fine adjustment amount is between about −10% and about +10% of the electrical potential across the adjacent at least one low voltage coil.

4. The power transformer assembly of claim 3, wherein a de-energized tap changer associated with the adjacent at least one low voltage coil is configured for adjusting the ratio of coils available for magnetic coupling with the adjacent at least one high voltage coil;

wherein each successive tap on the adjacent at least one low voltage coil is configured to induce a coarse adjustment in voltage available to the output of the power transformer.

5. The power transformer assembly of claim 4, wherein the fine adjustment amount is between about −2.5% and about +2.5% of the electrical potential across the low voltage coil.

6. The power transformer assembly of claim 1 wherein the principal housing has a vertically oriented wall, and wherein the auxiliary housing extends outwardly from said vertically oriented wall.

7. The power transformer assembly of claim 6 wherein the auxiliary housing has an upper wall, the said upper auxiliary housing upper wall having an opening, with the load tap changer supported by the upper housing wall with the motor mounted above the load tap changer switches with the switches positioned within the auxiliary housing and submerged in the oil, the auxiliary housing upper wall being sized to allow the switches to be installed by moving the switches downwardly through the said auxiliary housing upper wall opening.

8. The power transformer assembly of claim 7 wherein the auxiliary housing has a sidewall, the said auxiliary housing side wall having an opening, and a cover member sized to be large enough to be mounted on the auxiliary housing side wall and secured thereto to cover the auxiliary housing side wall opening and seal the opening.

9. The power transformer assembly of claim 6 wherein the principal housing has a floor that forms the bottom of the principal housing main chamber, and wherein the auxiliary housing has a lower wall that extends outwardly from the principal housing vertically oriented wall at a position above the principal housing floor.

10. The power transformer assembly of claim 7 wherein the principal housing has an upper wall, and wherein the upper wall of the auxiliary housing is positioned to be beneath the level of the principal housing upper wall.

11. A power transformer assembly for supplying electrical power to at least one consumer, comprising:

a power transformer having an input terminal configured to connect to and receive alternating electrical current from an external source;

a principal housing having a main chamber and a rear chamber, with the main chamber housing at least one high voltage coil and retaining oil surrounding the at least one high voltage coil, an auxiliary housing configured on an outer portion of the principal housing defining a cavity that is fluidly connected to the main chamber via a passageway that is configured for receiving electrical wiring, the at least one high voltage coil having an input positioned on the principal housing configured to electrically connect to an external power source, the power transformer having at least one primary coil with a plurality of taps associated with a range of winding ratios, the at least one primary coil positioned within the outer housing and electrically coupled to the input and configured to receive an electrical current from the external source, the power transformer also having at least one secondary coil within the outer housing and configured to be magnetically coupled to the at least one primary coil to provide an induced current through said magnetic coupling, an output positioned on the principal housing electrically coupled to the electrically coupled at least one secondary coil and capable for supplying electrical power to the at least one consumer on demand:

at least one potential transformer positioned within said principal housing and configured to be electrically coupled to the at least one secondary coil and having the capability to measure, scale and generate a representative value of the electrical potential across the electrically coupled at least one secondary coil;

a load tap changer having a controller, a motor and a plurality of switches each with one or more connectors/terminals configured to connect to electrical wiring connected to each of the plurality of taps on the at least one high voltage coil of the power transformer, the plurality of the switches being positioned within the auxiliary housing cavity to be submerged by the oil in fluid flow connection with the main chamber, and being configured to adjust a winding ratio of the at least one primary coil associated with the magnetic coupling by selecting a tap to electrically connect to the input of the power transformer;

the load tap changer controller mounted in association with the principal housing;

a de-energized tap changer mounted within the auxiliary housing cavity and electrically connected to the electrically coupled at least one secondary coil;

wherein the at least one potential transformer is electrically connected to the at least one input of the load tap changer controller with the said controller configured to receive the representative value of the electrical potential across the electrically coupled at least one secondary coil, and wherein upon determination that the representative value of the electrical potential across the electrically coupled at least one secondary coil needs to be adjusted, the load tap changer controller is configured to electrically communicate with the load tap changer to adjust the switches and electrical connections of the load tap changer electrical wiring that are submerged in the oil of the main chamber and the auxiliary housing cavity providing that the selected tap of the primary coil that is electrically connected to the input of the power transformer to adjust the winding ratio of magnetic coupling on the primary coil, such that the magnetic coupling is configured to be shifted while providing a continuous supply of electrical power to the at least one consumer.

12. An apparatus for assembly within a power transformer, the power transformer having a principal housing having a main chamber configured for receiving at least one high voltage coil and retaining oil surrounding the at least one high voltage coil, an auxiliary housing configured on an outer portion of the principal housing defining a cavity that is fluidly connected to the main chamber via a passageway that is configured for receiving electrical wiring, the power transformer having an input for electrically supplying power to the power transformer assembly from an external power source, a first triad of coils in a three-phase power configuration electrically coupled to the input, a second triad of coils in a three-phase configuration configured to be magnetically coupled to the first triad of coils, wherein the first triad of coils is configured to induce an electrical current in the second triad of coils through said magnetic coupling, an output electrically coupled to the second triad of coils for supplying electrical power to at least one consumer on demand, a potential transformer with at least one input electrically coupled, respectively, to the at least one of the coils of the second triad and configured to measure and scale the electrical potential across the individual coils, a load tap changer having a controller, a motor and a plurality of switches each with one or more connectors/terminals configured to connect to electrical wiring connected to each of the plurality of taps on the at least one high voltage coil of the power transformer, the plurality of the switches being positioned within the auxiliary housing cavity to be submerged by the oil in the main chamber, the apparatus further comprising:

a bottom frame member having opposing side members fixed relative to and spaced apart from each other to define a center channel extending along the length of the opposing side members, the bottom frame member having a plurality of crossbeams extending across the channel to connect the opposing side members;

a top frame member positioned vertically above the bottom frame member including opposing members spaced apart and fixed relative to each other to define a center channel extending between the opposing members, the top frame further including a plurality of crossbeams extending across the channel, wherein the channel defined by the top frame member is generally parallel to the channel defined by the bottom frame member;

a triad of pairs of vertical beams, the respective pairs positioned to extend between the top and bottom opposing members respectively, with the vertical beams, the opposing members and the crossbeams connected in a serially boxlike configuration defining a support cage;

a pair of lattices positioned adjacent to the vertical beams on opposite sides of the boxlike configuration, the lattices comprised of a plurality of horizontal and vertical beams connected in a generally cross like pattern, the beams positioned such that a plurality of horizontal and vertical cable guide channels are positioned between the beams of the generally cross like pattern; and a plurality of guiding cleats positioned on the lattices along the cable guide channels and configured so that that electrical cables can be routed through the channels of the lattice.

* * * * *